US008172666B2

(12) United States Patent
Okada

(10) Patent No.: US 8,172,666 B2
(45) Date of Patent: May 8, 2012

(54) SLOT MACHINE

(75) Inventor: Kazuo Okada, Tokyo (JP)

(73) Assignee: Aruze Gaming America, Inc., Las Vegas, NV (US)

( * ) Notice: Subject to any disclaimer, the term of this patent is extended or adjusted under 35 U.S.C. 154(b) by 440 days.

(21) Appl. No.: 12/416,444

(22) Filed: Apr. 1, 2009

(65) Prior Publication Data

US 2009/0247276 A1 Oct. 1, 2009

Related U.S. Application Data

(60) Provisional application No. 61/041,327, filed on Apr. 1, 2008.

(51) Int. Cl.
*A63F 9/24* (2006.01)

(52) U.S. Cl. ..... 463/20; 463/34

(58) Field of Classification Search ..... 463/20, 463/34

See application file for complete search history.

(56) References Cited

U.S. PATENT DOCUMENTS

| | | | | |
|---|---|---|---|---|
| 4,306,768 | A | 12/1981 | Egging | 350/174 |
| 4,371,870 | A | 2/1983 | Biferno | 340/716 |
| 4,454,670 | A | 6/1984 | Bachmann et al. | 194/350 |
| 4,517,558 | A | 5/1985 | Davids | 340/700 |
| 4,518,225 | A | 5/1985 | Fredrickson et al. | 350/338 |
| 4,562,433 | A | 12/1985 | Biferno | 340/716 |
| 4,568,928 | A | 2/1986 | Biferno | 340/716 |
| 4,718,672 | A | 1/1988 | Okada | 273/143 |
| 4,756,414 | A | 7/1988 | Mott | 206/328 |
| 4,826,296 | A | 5/1989 | Yoshimura | 350/338 |
| 4,976,429 | A | 12/1990 | Nagel | 273/1 |
| 4,998,804 | A | 3/1991 | Horiuchi | 350/334 |
| 5,146,354 | A | 9/1992 | Plesinger | 359/49 |
| 5,152,529 | A | 10/1992 | Okada | 273/143 |

(Continued)

FOREIGN PATENT DOCUMENTS

AU 1999-043488 3/2000

(Continued)

OTHER PUBLICATIONS

"Bigfoot" Product Sheet, Shuffle Master, Inc., 1 page (2000). "Big Games Safari" Product Sheet, IGT, 24 pages (2000).
"Cabby Cash™" Product Sheet, Anchor Gaming, 2 pages (2000).
"Congo Quest™" Product Sheet, Anchor Gaming, 2 pages (2000).
"Fishin' Buddies™" Product Sheet, Anchor Gaming, 2 pages (2000).
Legato, Frank, "The Full Monty," Strictly Slots, pp. 48-50 (Jun. 1999).

(Continued)

*Primary Examiner* — William D Coleman
(74) *Attorney, Agent, or Firm* — Nixon Peabody LLP

(57) ABSTRACT

A slot machine according to the present invention includes: a plurality of reels having thereon plural types of symbols set in array; a display device having a symbol matrix display region having therein the plurality of symbols set in array on the reel, and a symbol image display region for displaying a symbol image of a symbol not arranged in the symbol matrix display image; a memory storing symbol image data relating to symbols identical or similar to the plural types of symbols set in array on the reel, and reel image data relating to a reel having a reel shape; and a controller for controlling the reels, the display device, and the memory. The controller is programmed to: rearrange the plural types of symbols in the symbol matrix display region; read out of the memory the reel image data and symbol image data corresponding to the symbol not arranged in the symbol matrix display region; and display in the symbol image display region, the reel image in which the symbol image is filled in the reel image having the reel shape, in a manner to correspond to display on the symbol matrix display region.

20 Claims, 23 Drawing Sheets

U.S. PATENT DOCUMENTS

| | | | | |
|---|---|---|---|---|
| 5,258,844 | A | 11/1993 | Nakayama et al. | 358/209 |
| 5,283,560 | A | 2/1994 | Bartlett | 345/113 |
| 5,351,966 | A | 10/1994 | Tohyama et al. | 273/311 |
| 5,372,745 | A | 12/1994 | Yoshinaga | 252/299 |
| 5,375,043 | A | 12/1994 | Tokunaga | 362/31 |
| 5,393,061 | A | 2/1995 | Manship et al. | 273/143 R |
| 5,546,296 | A | 8/1996 | Savignac et al. | 363/60 |
| 5,580,055 | A | 12/1996 | Hagiwara | 273/143 R |
| 5,636,101 | A | 6/1997 | Bonsall et al. | 361/681 |
| 5,667,439 | A | 9/1997 | Okada | 463/20 |
| 5,673,128 | A | 9/1997 | Ohta et al. | 349/62 |
| 5,691,788 | A | 11/1997 | Kim | 349/96 |
| 5,695,188 | A | 12/1997 | Ishibashi | 273/143 R |
| 5,697,843 | A | 12/1997 | Manship et al. | 463/20 |
| 5,722,891 | A | 3/1998 | Inoue | 463/20 |
| 5,725,210 | A | 3/1998 | Yamaguchi et al. | 273/121 |
| 5,725,428 | A | 3/1998 | Achmuller | 463/20 |
| 5,745,199 | A | 4/1998 | Suzuki et al. | 349/95 |
| 5,752,881 | A | 5/1998 | Inoue | 463/20 |
| 5,768,095 | A | 6/1998 | Nakamura et al. | 361/681 |
| 5,810,665 | A | 9/1998 | Takemoto et al. | 463/31 |
| 5,836,819 | A | 11/1998 | Ugawa | 463/30 |
| 5,890,962 | A | 4/1999 | Takemoto | 463/20 |
| 5,920,256 | A | 7/1999 | Toffolo | 340/461 |
| 5,934,672 | A | 8/1999 | Sines et al. | 273/143 R |
| 5,980,384 | A | 11/1999 | Barrie | 463/16 |
| 6,027,115 | A | 2/2000 | Griswold et al. | 273/143 R |
| 6,036,188 | A | 3/2000 | Gomez et al. | 273/118 R |
| 6,038,188 | A | 3/2000 | Akamatsu | 365/226 |
| 6,056,642 | A | 5/2000 | Bennett | 463/20 |
| 6,086,066 | A | 7/2000 | Takeuchi et al. | 273/143 R |
| 6,089,977 | A | 7/2000 | Bennett | 463/20 |
| 6,093,102 | A | 7/2000 | Bennett | |
| 6,095,921 | A | 8/2000 | Walker et al. | 463/20 |
| 6,135,884 | A | 10/2000 | Hedrick et al. | 463/20 |
| 6,135,885 | A | 10/2000 | Lermusiaux | 463/20 |
| 6,141,067 | A | 10/2000 | Ikka | 349/65 |
| 6,151,169 | A | 11/2000 | Kim | 359/640 |
| 6,159,097 | A | 12/2000 | Gura | 463/20 |
| 6,164,645 | A | 12/2000 | Weiss | 273/138.2 |
| 6,181,301 | B1 | 1/2001 | Inoguchi et al. | 345/5 |
| 6,190,255 | B1 | 2/2001 | Thomas et al. | 463/20 |
| 6,193,606 | B1 | 2/2001 | Walker et al. | 463/20 |
| 6,219,228 | B1 | 4/2001 | Sun | 361/683 |
| 6,224,482 | B1 | 5/2001 | Bennett | 463/20 |
| 6,251,013 | B1 | 6/2001 | Bennett | 463/13 |
| 6,261,177 | B1 | 7/2001 | Bennett | 463/16 |
| 6,270,411 | B1 | 8/2001 | Gura et al. | 463/20 |
| 6,290,600 | B1 | 9/2001 | Glasson | 463/20 |
| 6,315,663 | B1 | 11/2001 | Sakamoto | 463/20 |
| 6,317,128 | B1 | 11/2001 | Harrison et al. | 345/629 |
| 6,339,418 | B1 | 1/2002 | Kitagawa | 345/102 |
| 6,364,766 | B1 | 4/2002 | Anderson et al. | 463/16 |
| 6,368,216 | B1 | 4/2002 | Hedrick et al. | 463/20 |
| 6,375,568 | B1 | 4/2002 | Roffman et al. | 463/26 |
| 6,377,339 | B1 | 4/2002 | Westerman | 355/75 |
| 6,406,159 | B1 | 6/2002 | Yamamoto | 362/31 |
| 6,419,579 | B1 | 7/2002 | Bennett | 463/20 |
| 6,475,087 | B1 | 11/2002 | Cole | 463/20 |
| 6,517,432 | B1 | 2/2003 | Jaffe | 463/16 |
| 6,517,433 | B2 | 2/2003 | Loose | 463/20 |
| 6,600,527 | B1 | 7/2003 | Basturk et al. | 349/74 |
| 6,604,999 | B2 | 8/2003 | Ainsworth | |
| 6,623,006 | B2 | 9/2003 | Weiss | 273/138 |
| 6,638,165 | B2 | 10/2003 | Uchiyama et al. | 463/20 |
| 6,642,975 | B2 | 11/2003 | Chino et al. | 349/65 |
| 6,695,696 | B1 | 2/2004 | Kaminkow | 463/16 |
| 6,705,611 | B2 | 3/2004 | Kato | 273/143 R |
| 6,720,021 | B2 | 4/2004 | Wong et al. | 426/633 |
| 6,720,961 | B2 | 4/2004 | Tracy | 345/419 |
| 6,734,927 | B2 | 5/2004 | Sato | 349/58 |
| 6,790,140 | B1 | 9/2004 | Niwa | 463/20 |
| 6,802,575 | B1 | 10/2004 | Lee | 312/72 |
| 6,811,273 | B2 | 11/2004 | Satoh et al. | 362/27 |
| 6,817,946 | B2 | 11/2004 | Motegi et al. | 463/31 |
| 6,820,875 | B1 | 11/2004 | Hedrick et al. | 273/138.1 |
| 6,824,466 | B1 | 11/2004 | Hirota | 463/20 |
| 6,837,790 | B1 | 1/2005 | Kaminkow | 463/31 |
| 6,853,410 | B2 | 2/2005 | Matsuda et al. | 349/67 |
| 6,893,345 | B2 | 5/2005 | Motegi et al. | 463/31 |
| 6,923,721 | B2 | 8/2005 | Luciano et al. | 463/24 |
| 6,937,298 | B2 | 8/2005 | Okada | 349/58 |
| 6,942,571 | B1 | 9/2005 | McAllister et al. | 463/20 |
| 6,954,238 | B2 | 10/2005 | Liu et al. | 349/65 |
| 6,976,915 | B2 | 12/2005 | Baker et al. | 463/1 |
| 7,092,048 | B2 | 8/2006 | Jeong | 349/58 |
| 7,097,560 | B2 | 8/2006 | Okada | 463/20 |
| 7,115,033 | B1 | 10/2006 | Timperley | 463/20 |
| 7,140,963 | B2 | 11/2006 | Kojima | 463/20 |
| 7,159,865 | B2 | 1/2007 | Okada | 273/143 |
| 7,160,187 | B2 | 1/2007 | Loose et al. | 463/20 |
| 7,166,029 | B2 | 1/2007 | Enzminger | 463/20 |
| 7,169,048 | B2 | 1/2007 | Nozaki et al. | 463/30 |
| 7,204,753 | B2 | 4/2007 | Ozaki et al. | 463/16 |
| 7,207,883 | B2 | 4/2007 | Nozaki et al. | 463/24 |
| 7,219,893 | B2 | 5/2007 | Tanimura et al. | 273/143 |
| 7,220,181 | B2 | 5/2007 | Okada | 463/32 |
| 7,234,697 | B2 | 6/2007 | Okada | 273/143 |
| 7,255,643 | B2 | 8/2007 | Ozaki et al. | 463/20 |
| 7,281,980 | B2 | 10/2007 | Okada | 463/20 |
| 7,322,884 | B2 | 1/2008 | Emori et al. | 463/16 |
| 7,329,181 | B2 | 2/2008 | Hoshino et al. | 463/20 |
| 7,355,660 | B2 | 4/2008 | Ikeda | 349/60 |
| 7,390,259 | B2 | 6/2008 | Okada | 463/20 |
| 7,404,766 | B2 | 7/2008 | Adachi et al. | 463/31 |
| 7,458,890 | B2 | 12/2008 | Loose et al. | 463/16 |
| 7,465,228 | B2 | 12/2008 | Okada | 463/20 |
| 7,479,061 | B2 | 1/2009 | Okada | 463/20 |
| 7,479,066 | B2 | 1/2009 | Emori | 463/46 |
| 7,485,039 | B2 | 2/2009 | Okada | 463/20 |
| 7,510,475 | B2 | 3/2009 | Loose et al. | 463/31 |
| 7,510,476 | B2 | 3/2009 | Kobayashi | 463/31 |
| 7,520,812 | B2 | 4/2009 | Okada | 463/31 |
| 7,585,220 | B2 | 9/2009 | Loose et al. | 463/20 |
| 7,695,364 | B2 | 4/2010 | Okada | 463/20 |
| 7,730,413 | B1 | 6/2010 | Engel et al. | 715/764 |
| 7,874,909 | B2 * | 1/2011 | Pryzby et al. | 463/20 |
| 2001/0000636 | A1 | 5/2001 | Weiss | 273/138.2 |
| 2001/0013681 | A1 | 8/2001 | Bruzzese et al. | 273/143 |
| 2001/0019479 | A1 | 9/2001 | Nakabayashi et al. | 362/31 |
| 2001/0031658 | A1 | 10/2001 | Ozaki et al. | 463/16 |
| 2001/0050736 | A1 | 12/2001 | Lee et al. | 349/65 |
| 2001/0052955 | A1 | 12/2001 | Nagatani | 349/65 |
| 2002/0063816 | A1 | 5/2002 | Nakamura et al. | 349/65 |
| 2002/0065124 | A1 | 5/2002 | Ainsworth | |
| 2002/0142830 | A1 | 10/2002 | Adams | 463/20 |
| 2002/0175466 | A1 | 11/2002 | Loose et al. | 273/143 |
| 2003/0016313 | A1 | 1/2003 | Jeong | 349/58 |
| 2003/0060269 | A1 | 3/2003 | Paulsen et al. | 463/20 |
| 2003/0087689 | A1 | 5/2003 | Adams | 463/20 |
| 2003/0087690 | A1 | 5/2003 | Loose et al. | 463/20 |
| 2003/0130028 | A1 | 7/2003 | Aida et al. | 463/20 |
| 2003/0157980 | A1 | 8/2003 | Loose et al. | 463/20 |
| 2003/0162579 | A1 | 8/2003 | Gauselmann | 463/16 |
| 2003/0166417 | A1 | 9/2003 | Moriyama et al. | 463/46 |
| 2003/0184690 | A1 | 10/2003 | Ogiwara et al. | 349/61 |
| 2003/0214471 | A1 | 11/2003 | Topelberg | 345/87 |
| 2003/0234489 | A1 | 12/2003 | Okada | 273/236 |
| 2003/0236118 | A1 | 12/2003 | Okada | 463/20 |
| 2004/0014520 | A1 | 1/2004 | Okada | 463/20 |
| 2004/0021705 | A1 | 2/2004 | Baker et al. | 347/2 |
| 2004/0029636 | A1 | 2/2004 | Wells | 463/32 |
| 2004/0048646 | A1 | 3/2004 | Visocnik | 463/16 |
| 2004/0052078 | A1 | 3/2004 | Hosaka | 362/302 |
| 2004/0062025 | A1 | 4/2004 | Satoh et al. | 362/27 |
| 2004/0063490 | A1 | 4/2004 | Okada | 463/20 |
| 2004/0116178 | A1 | 6/2004 | Okada | 463/20 |
| 2004/0147303 | A1 | 7/2004 | Imura et al. | 463/16 |
| 2004/0150162 | A1 | 8/2004 | Okada | 273/292 |
| 2004/0152501 | A1 | 8/2004 | Okada | 463/16 |
| 2004/0152502 | A1 | 8/2004 | Okada | 463/16 |
| 2004/0166925 | A1 | 8/2004 | Emori et al. | 463/20 |
| 2004/0166926 | A1 | 8/2004 | Adachi et al. | 463/20 |
| 2004/0171418 | A1 | 9/2004 | Okada | 463/20 |
| 2004/0192441 | A1 | 9/2004 | Nonaka | 463/31 |
| 2004/0198485 | A1 | 10/2004 | Loose et al. | 463/20 |
| 2004/0207154 | A1 | 10/2004 | Okada | 273/138.1 |

| | | | | |
|---|---|---|---|---|
| 2004/0209666 | A1 | 10/2004 | Tashiro et al. | 463/20 |
| 2004/0209667 | A1 | 10/2004 | Emori et al. | 463/20 |
| 2004/0209668 | A1 | 10/2004 | Okada | 463/20 |
| 2004/0209670 | A1 | 10/2004 | Adachi et al. | 463/20 |
| 2004/0209671 | A1 | 10/2004 | Okada | 463/20 |
| 2004/0209672 | A1 | 10/2004 | Okada | 463/20 |
| 2004/0209676 | A1 | 10/2004 | Onishi et al. | 463/29 |
| 2004/0209678 | A1 | 10/2004 | Okada | 463/30 |
| 2004/0209679 | A1 | 10/2004 | Nonaka | 463/30 |
| 2004/0209681 | A1 | 10/2004 | Emori et al. | 463/31 |
| 2004/0209682 | A1 | 10/2004 | Okada | 463/31 |
| 2004/0209683 | A1 | 10/2004 | Okada | 463/31 |
| 2004/0214635 | A1 | 10/2004 | Okada | 463/30 |
| 2004/0214636 | A1 | 10/2004 | Nonaka | 463/30 |
| 2004/0214637 | A1 | 10/2004 | Nonaka | 463/31 |
| 2004/0219965 | A1 | 11/2004 | Okada | 463/16 |
| 2004/0224747 | A1 | 11/2004 | Okada | 463/16 |
| 2004/0224758 | A1 | 11/2004 | Okada et al. | 463/31 |
| 2004/0227286 | A1 | 11/2004 | Tanimura et al. | 273/143 |
| 2004/0227866 | A1 | 11/2004 | Okada | 349/58 |
| 2004/0229680 | A1 | 11/2004 | Hoshino et al. | 463/20 |
| 2004/0229686 | A1 | 11/2004 | Tanimura et al. | 463/30 |
| 2004/0242323 | A1 | 12/2004 | Okada | 463/31 |
| 2004/0266510 | A1 | 12/2004 | Kojima | 463/16 |
| 2004/0266515 | A1 | 12/2004 | Gauselmann | 463/20 |
| 2004/0266521 | A1 | 12/2004 | Kojima | 463/20 |
| 2005/0020349 | A1 | 1/2005 | Tachikawa | 463/20 |
| 2005/0032571 | A1 | 2/2005 | Asonuma | 463/20 |
| 2005/0049030 | A1 | 3/2005 | Tachikawa | 463/20 |
| 2005/0049032 | A1 | 3/2005 | Kobayashi | 463/20 |
| 2005/0054433 | A1 | 3/2005 | Iwamoto | 463/25 |
| 2005/0140088 | A1 | 6/2005 | Randall | 273/143 |
| 2005/0153775 | A1 | 7/2005 | Griswold et al. | 463/30 |
| 2005/0170879 | A1 | 8/2005 | Tachikawa | 463/16 |
| 2005/0187003 | A1 | 8/2005 | Adachi et al. | 463/16 |
| 2005/0187006 | A1 | 8/2005 | Tachikawa | 463/20 |
| 2005/0187007 | A1 | 8/2005 | Kuroiwa | 463/20 |
| 2005/0187009 | A1 | 8/2005 | Osawa | 463/20 |
| 2005/0192083 | A1 | 9/2005 | Iwamoto | 463/20 |
| 2005/0192084 | A1 | 9/2005 | Iwamoto | 463/20 |
| 2005/0192085 | A1 | 9/2005 | Iwamoto | 463/20 |
| 2005/0192090 | A1 | 9/2005 | Muir et al. | 463/30 |
| 2005/0255908 | A1 | 11/2005 | Wells | 463/20 |
| 2005/0272500 | A1 | 12/2005 | Tanimura et al. | 463/20 |
| 2005/0282616 | A1 | 12/2005 | Tanimura et al. | 463/20 |
| 2005/0282617 | A1 | 12/2005 | Sekiguchi et al. | 463/20 |
| 2006/0014580 | A1 | 1/2006 | Hawthorn | 463/20 |
| 2006/0089192 | A1 | 4/2006 | Okada | 463/20 |
| 2006/0128467 | A1 | 6/2006 | Thomas | 463/31 |
| 2006/0135248 | A1 | 6/2006 | Anderson et al. | 463/22 |
| 2006/0252496 | A1 | 11/2006 | Rasmussen | 463/20 |
| 2006/0281530 | A1 | 12/2006 | Seelig et al. | 463/20 |
| 2007/0004513 | A1 * | 1/2007 | Wells et al. | 463/31 |
| 2007/0054730 | A1 | 3/2007 | Mattice et al. | 463/16 |
| 2007/0060296 | A1 | 3/2007 | Yoshizawa | 463/20 |
| 2007/0123348 | A1 | 5/2007 | Nozaki | 463/30 |
| 2007/0149281 | A1 | 6/2007 | Gadda et al. | 463/34 |
| 2007/0184893 | A1 | 8/2007 | Fujimoto | 463/20 |
| 2008/0020820 | A1 | 1/2008 | Iwamoto | 463/20 |
| 2008/0125210 | A1 | 5/2008 | Iwamoto | 463/20 |
| 2008/0176653 | A1 | 7/2008 | Kishi | 463/31 |
| 2008/0261674 | A9 | 10/2008 | Okada | 463/16 |
| 2008/0311977 | A1 | 12/2008 | Okada | 463/20 |
| 2009/0131148 | A1 | 5/2009 | Loose et al. | 463/20 |
| 2009/0181758 | A1 | 7/2009 | Loose et al. | 463/20 |
| 2009/0247276 | A1 | 10/2009 | Okada | 463/20 |

FOREIGN PATENT DOCUMENTS

| | | | |
|---|---|---|---|
| AU | 2000-030185 | | 11/2000 |
| CA | 2282782 | | 3/2000 |
| EP | 0060019 | | 9/1982 |
| EP | 0789338 | | 8/1997 |
| EP | 1260928 | | 11/2002 |
| EP | 1376494 | | 1/2004 |
| EP | 1376495 | | 1/2004 |
| EP | 1424663 | | 6/2004 |
| GB | 2124505 | A | 2/1984 |
| GB | 2165074 | A | 4/1986 |
| GB | 2242052 | A | 9/1991 |
| GB | 2253299 | A | 9/1992 |
| GB | 2349494 | A | 11/2000 |
| JP | 60-061079 | | 4/1985 |
| JP | 61-279272 | | 12/1986 |
| JP | 2019182 | | 1/1990 |
| JP | 04-109977 | | 4/1992 |
| JP | 04-114676 | | 4/1992 |
| JP | 1992-220275 | | 8/1992 |
| JP | 04-341288 | | 11/1992 |
| JP | 05-177043 | | 7/1993 |
| JP | 06-039085 | | 2/1994 |
| JP | 1994-142279 | | 5/1994 |
| JP | 07-016340 | | 1/1995 |
| JP | 07-124290 | | 5/1995 |
| JP | 07-299189 | | 11/1995 |
| JP | 08-010381 | | 1/1996 |
| JP | 08-080364 | | 3/1996 |
| JP | 08-103541 | | 4/1996 |
| JP | 2531253 | | 1/1997 |
| JP | 09-207625 | | 8/1997 |
| JP | 10-071228 | | 3/1998 |
| JP | 10-091076 | | 4/1998 |
| JP | 10-305130 | | 11/1998 |
| JP | 10-328398 | | 12/1998 |
| JP | 11-090017 | | 4/1999 |
| JP | 11-099240 | | 4/1999 |
| JP | 11-137774 | | 5/1999 |
| JP | 11-153970 | | 6/1999 |
| JP | 11-206960 | | 8/1999 |
| JP | 11-244451 | | 9/1999 |
| JP | 11-253610 | | 9/1999 |
| JP | 2000-011725 | | 1/2000 |
| JP | 2000-189554 | | 7/2000 |
| JP | 2000-262738 | | 9/2000 |
| JP | 2000-300729 | | 10/2000 |
| JP | 2000-300731 | | 10/2000 |
| JP | 2000-350805 | | 12/2000 |
| JP | 2001-025546 | | 1/2001 |
| JP | 2001-058046 | | 3/2001 |
| JP | 2001-062032 | | 3/2001 |
| JP | 2001-137461 | | 5/2001 |
| JP | 2001-238995 | | 9/2001 |
| JP | 2001-252393 | | 9/2001 |
| JP | 2001-252394 | | 9/2001 |
| JP | 2002-113150 | | 4/2002 |
| JP | 2003-236037 | | 8/2003 |
| JP | 2003-260184 | | 9/2003 |
| JP | 2004-008705 | | 1/2004 |
| RU | 2000128696 | | 10/2002 |
| RU | 2001103774 | | 1/2003 |
| WO | WO 98/03962 | A1 | 1/1998 |
| WO | WO 99/53454 | A1 | 10/1999 |
| WO | WO 99/64997 | A1 | 12/1999 |
| WO | WO 00/32286 | A1 | 6/2000 |
| WO | WO 01/28647 | A1 | 4/2001 |
| WO | WO 01/72387 | A1 | 10/2001 |
| WO | WO 03/039699 | A1 | 5/2003 |
| WO | WO 2006/036948 | A2 | 4/2006 |
| WO | WO 2006/124976 | A1 | 11/2006 |
| WO | WO 2007/011717 | A2 | 1/2007 |

OTHER PUBLICATIONS

"Goooaal!" Product Sheet, Bally Gaming, Inc., 2 pages (2000).
"Great Whites" Product Sheet, VLC, Inc., 2 pages (2000).
"Jackpot Stampede Deluxe™" Product Sheet, WMS Gaming Inc., 2 pages (1997).
"Loaded Dice" Product Sheet, Konami Gaming, 2 pages (2000).
"Neptune's Pearls" Product Sheet, Unidesa Gaming, 4 pages (1998).
"Penguin Pays" Product Sheet, Aristocrat Incorporated, 2 pages (1998).
"Stroke of Luck™" Product Sheet, WMS Gaming Inc., 2 pages (1997).
"Wild Cougar" Article, Strictly Slots, p. 44 (Feb. 1999).
"Yahtzee® Brand Video Game" Product Brochure, Hasbro, Inc., 2 pages (2000).

* cited by examiner

FIG.7

| SYMBOL | PAYOUT |
|---|---|
| WILD–WILD–WILD | 200 |
| 7 – 7 – 7 | 100 |
| 3Bar–3Bar–3Bar | 30 |
| 2Bar–2Bar–2Bar | 20 |
| 1Bar–1Bar–1Bar | 10 |
| LOSE | 0 |

SLOT MACHINE

CROSS-REFERENCE TO RELATED APPLICATIONS

This application claims priority of U.S. Provisional Application No. 61/041,327 filed on Apr. 1, 2008. The contents of this application are incorporated herein by reference in their entirety.

BACKGROUND OF THE INVENTION

1. Field of the Invention

The present invention relates to a slot machine.

2. Description of the Related Art

In a conventional slot machine, when a player inserts a game medium, such as a coin and a bill, in an insertion slot of a slot machine and presses a SPIN button, a display provided on a front face of a cabinet displays a plurality of symbols in a scrolling manner. Then, scrolling of each of the symbols automatically stops.

As such a slot machine, for example, as disclosed in U.S. Pat. No. 6,093,102, a slot machine exists which employs a concept of a winning line. In this concept, in a case where a combination of symbols rearranged on a winning line is a predetermined winning combination, a predetermined number of game media are paid out.

In addition, as such a slot machine, for example, as disclosed in each of U.S. Pat. No. 6,604,999 and U.S. Patent Publication No. 2002/0065124, a slot machine exists which provides two types of payouts, including a payout determined by a combination of symbols rearranged on a winning line and a payout determined by a number of displayed scatter symbols.

The above-described conventional slot machine, however, allows players to have expectations only for random payout based on a combination of plural types of symbols that have been randomly arranged in the display device. Accordingly, a need exists for the advent of a slot machine which can offer new entertainability.

The present invention has been made in view of the above-described circumstance which can offer entertainability to players that has not been successfully attained by those of the aforementioned conventional art.

SUMMARY OF THE INVENTION

A first aspect of the present invention is a slot machine including: a plurality of reels having thereon plural types of symbols set in array; a display device including both a symbol matrix display region having therein in column and row directions, the plurality of symbols set in array on the reel, and a symbol image display region for displaying a symbol image of a symbol not arranged in the symbol matrix display image; a memory storing symbol image data relating to symbols identical or similar to the plural types of symbols set in array on the reel, and reel image data relating to a reel having a reel shape; and a controller for controlling the reels, the display device, and the memory. The controller is programmed to: (a) execute a basic game; (b) rearrange by displaying in a scrolling manner, the plural types of symbols in the symbol matrix display region by controlling the plurality of reels during the basic game; (c) award a payout in a case where the symbols displayed in the symbol matrix display region are arranged in a predetermined combination on a winning line; (d) read out of the memory, the reel image data and symbol image data corresponding to the symbol not arranged in the symbol matrix display region, from among the symbols set in array on the reel, and generate, based on the reel image data and the symbol image data read out of the memory, image display data in which the symbol image of the symbol not arranged in the symbol matrix display region is filled in a reel image having the reel shape, from among the symbols set in array on the reel; and (e) display in the symbol image display region, the reel image in which the symbol image is filled in the reel image having the reel shape, in a manner to correspond to display on the symbol matrix display region, based on the image display data.

According to the first aspect, the symbol image of the symbol not arranged in the symbol matrix display region can be visually confirmed by displaying the reel image in a manner to correspond to the arranged symbols. For example, players can be informed of the remaining number of frames to win a prize, by displaying the symbols having not been arranged. Therefore, a novel slot machine can be provided which allows players to enjoy new entertainability in addition to conventional entertainability.

A second aspect of the present invention is a slot machine constituted as set forth below. In the first aspect, the controller, in the itemized (d), executes a first process and a second process. The first process is for generating the image display data as if the reel is visually confirmed from a side of the symbol matrix display region. The second process is for generating the image display data as if the reel is visually confirmed from an opposite side of the symbol matrix display region.

According to the second aspect, the reel image can be displayed as if the symbol image of the symbol not arranged in the symbol matrix display region is visually confirmed from a side of the symbol matrix display region or an opposite side thereof in a manner to correspond to the rearranged symbols. Thus, players can be informed of the symbols arranged on the reel by visually confirming the symbols having not been arranged, for example. Therefore, a novel slot machine can be provided which allows players to enjoy new entertainability in addition to conventional entertainability.

A third aspect of the present invention is a slot machine constituted as set forth below. In the first aspect, the controller executes the itemized (d) and the itemized (e), on condition that arrangement of one of the symbols from among the symbols displayed in the symbol matrix display region does not form the predetermined combination on the winning line.

According to the third aspect, on the condition that arrangement of the symbols does not form a predetermined combination on a winning line, the symbol image of the symbol not arranged in the symbol matrix display region can be visually confirmed by displaying the reel image in a manner to correspond to the arranged symbols. Thus, players can be informed of the remaining number of frames to win a prize, by displaying the symbols having not been arranged, for example. Therefore, a novel slot machine can be provided which allows players to enjoy new entertainability in addition to conventional entertainability.

A fourth aspect of the present invention is a slot machine constituted as set forth below. In the first aspect, the slot machine further includes an input device for accepting operation input. The controller executes the itemized (d) and the itemized (e) during a period from stop of the reels in the itemized (b) to acceptance of the operation input from the input device.

According to the fourth aspect, during a period after stop of rotation of the reel to acceptance of operation input, the reel image can be displayed with display of the symbol image of the symbol not arranged in the symbol matrix display region in a manner to correspond to the arranged symbols. For example, during a period after stop of rotation of the reel to push of a start button, players can be informed of the symbols arranged on the reel by visually confirming the symbols not arranged. Therefore, a novel slot machine can be provided which allows players to enjoy new entertainability in addition to conventional entertainability.

A fifth aspect of the present invention is a slot machine constituted as set forth below. In the first aspect, the memory stores frontside and backside symbol textures identical or similar to the plural types of symbols set in array on the reel, object data of a reel defined in a virtual three-dimensional space, and symbol array coordinate data for mapping the frontside and backside symbol textures on the object of the reel defined in the virtual three-dimensional space in a manner similar to array on the reel; and the controller, in the itemized (d), refers to the symbol array coordinate data on the object of the reel defined in the virtual three-dimensional space in the symbol image display region in a manner to correspond to display on the symbol matrix display region, based on the data read out of the memory, and then renders the object of the reel in real time by mapping the symbol textures of the symbol not arranged in the symbol matrix display region from among the symbols set in array on the reel.

According to the fifth aspect, the object of the reel is rendered in real time by mapping the symbol textures of the symbol not arranged in the symbol matrix display region by referring to the symbol array coordinate data on the object of the reel defined in the virtual three-dimensional space in the symbol image display region in a manner to correspond to the rearranged symbols. In this manner, the symbol having not been arranged can be visually confirmed, and thus, players can be informed of the symbols set in array on the reel by visually confirming the symbol not arranged, for example. Therefore, a novel slot machine can be provided which allows players to enjoy new entertainability in addition to conventional entertainability.

A sixth aspect of the present invention is a slot machine including: a plurality of reels having thereon plural types of symbols set in array; a display device including both a symbol matrix display region having therein in column and row directions, the plurality of symbols set in array on the reel, and a symbol image display region for displaying a symbol image of a symbol not arranged in the symbol matrix display image; a memory storing symbol image data relating to symbols identical or similar to the plural types of symbols set in array on the reel, and reel image data relating to a reel having a reel shape; and a controller for controlling the reels, the display device, and the memory. The controller is programmed to: (a) execute a basic game; (b) rearrange by displaying in a scrolling manner, the plural types of symbols in the symbol matrix display region by controlling the plurality of reels during the basic game; (c) award a payout in a case where the symbols displayed in the symbol matrix display region are arranged in a predetermined combination on a winning line; (d) read out of the memory, the reel image data and symbol image data corresponding to the symbol not arranged in the symbol matrix display region, from among the symbols set in array on the reel, and executes a first process and a second process, the first process being for generating, based on the reel image data and the symbol image data read out of the memory, image display data in which the symbol image of the symbol not arranged in the symbol matrix display region is filled in a reel image having the reel shape, from among the symbols set in array on the reel, as if the reel is visually confirmed from a side of the symbol matrix display region, the second process being for generating the image display data as if the reel is visually confirmed from an opposite side of the symbol matrix display region; and (e) display in the symbol image display region, the reel image that symbol image is filled in the reel image having the reel shape, in a manner to correspond to display on the symbol matrix display region, based on the image display data generated in the first process and the second process.

According to the sixth aspect, the reel image can be displayed as if the symbol image of the symbol not arranged in the symbol matrix display region is visually confirmed from a side of the symbol matrix display region or an opposite side thereof in a manner to correspond to the rearranged symbols. Thus, players can be informed of the symbols arranged on the reel by visually confirming the symbols having not been arranged, for example. Therefore, a novel slot machine can be provided which allows players to enjoy new entertainability in addition to conventional entertainability.

A seventh aspect of the present invention is a slot machine constituted as set forth below. In the sixth aspect, the controller executes the itemized (d) and the itemized (e), on condition that arrangement of one of the symbols from among the symbols displayed in the symbol matrix display region does not form the predetermined combination on the winning line.

According to the seventh aspect, on the condition that arrangement of the symbols does not form a predetermined combination on a winning line, the symbol image of the symbol not arranged in the symbol matrix display region can be visually confirmed by displaying the reel image in a manner to correspond to the arranged symbols. Thus, players can be informed of the remaining number of frames to win a prize, by displaying the symbols having not been arranged, for example. Therefore, a novel slot machine can be provided which allows players to enjoy new entertainability in addition to conventional entertainability.

An eighth aspect of the present invention is a slot machine constituted as set forth below. In the eighth aspect, the slot machine further includes an input device for accepting operation input. The controller executes the itemized (d) and the itemized (e) during a period from stop of the reels in the itemized (b) to acceptance of the operation input from the input device.

According to the eighth aspect, during a period after stop of rotation of the reel to acceptance of operation input, the reel image can be displayed with display of the symbol image of the symbol not arranged in the symbol matrix display region in a manner to correspond to the arranged symbols. For example, during a period after stop of rotation of the reel to push of a start button, players can be informed of the symbols arranged on the reel by visually confirming the symbols not arranged. Therefore, a novel slot machine can be provided which allows players to enjoy new entertainability in addition to conventional entertainability.

A ninth aspect of the present invention is a slot machine constituted as set forth below. In the ninth aspect, the memory stores frontside and backside symbol textures identical or similar to the plural types of symbols set in array on the reel, object data of a reel defined in a virtual three-dimensional space, and symbol array coordinate data for mapping the frontside and backside symbol textures on the object of the reel defined in the virtual three-dimensional space in a manner similar to array on the reel; and the controller, in the itemized (d), refers to the symbol array coordinate data on the object of the reel defined in the virtual three-dimensional space in the symbol image display region in a manner to correspond to display on the symbol matrix display region, based on the data read out of the memory, and then renders the object of the reel in real time by mapping the symbol textures of the symbol not arranged in the symbol matrix display region from among the symbols set in array on the reel.

According to the ninth aspect, the object of the reel is rendered in real time by mapping the symbol textures of the symbol not arranged in the symbol matrix display region by referring to the symbol array coordinate data on the object of the reel defined in the virtual three-dimensional space in the symbol image display region in a manner to correspond to the rearranged symbols. In this manner, the symbol having not been arranged can be visually confirmed, and thus, players can be informed of the symbols set in array on the reel by visually confirming the symbol not arranged, for example. Therefore, a novel slot machine can be provided which allows players to enjoy new entertainability in addition to conventional entertainability.

A tenth aspect of the present invention is a slot machine including: a plurality of reels having thereon plural types of symbols set in array; a display device including both a symbol matrix display region having therein in column and row directions, the plurality of symbols set in array on the reel, and a symbol image display region for displaying a symbol image of a symbol not arranged in the symbol matrix display image; a memory storing frontside and backside symbol textures identical or similar to the plural types of symbols set in array on the reel, object data of a reel defined in a virtual three-dimensional space, and symbol array coordinate data for mapping the frontside and backside symbol textures to an object of the reel defined in the virtual three-dimensional space in a manner similar to array on the reel; and a controller for controlling the reels, the display device, and the memory. The controller is programmed to: (a) execute a basic game; (b) rearrange by displaying in a scrolling manner, the plural types of symbols in the symbol matrix display region by controlling the plurality of reels during the basic game; (c) award a payout in a case where the symbols displayed in the symbol matrix display region are arranged in a predetermined combination on a winning line; (d) read out of the memory, (the?) frontside and backside symbol textures identical or similar to the symbol not arranged in the symbol matrix display region from among the symbols set in array on the reel, the object data of the reel defined in the virtual three-dimensional space, and the symbol array coordinate data; and (e) refer to the symbol array coordinate data on the object of the reel defined in the virtual three-dimensional space in the symbol image display region in a manner to correspond to display on the symbol matrix display region, based on the data read out of the memory, and then render the object of the reel in real time by mapping the symbol texture of the symbol not arranged in the symbol matrix display region from among the symbols set in array on the reel.

According to the tenth aspect, the object of the reel is rendered in real time by mapping the symbol textures of the symbol not arranged in the symbol matrix display region by referring to the symbol array coordinate data on the object of the reel defined in the virtual three-dimensional space in the symbol image display region in a manner to correspond to the rearranged symbols. In this manner, the symbol not arranged can be visually confirmed, and thus, players can be informed of the remaining number of frames to win a prize by visually confirming the symbol not arranged, for example. Therefore, a novel slot machine can be provided which allows players to enjoy new entertainability in addition to conventional entertainability.

An eleventh aspect of the present invention is a slot machine constituted as set forth below. In the tenth aspect, the controller, in the itemized (e), executes a first process and a second process; the first process is for rendering the object of the reel in real time by mapping, with referring to the symbol array coordinate data, the symbol textures on the object of the reel defined in the virtual three-dimensional space as if the reel is visually confirmed from a side of the symbol matrix display region; and the second process is for rendering the object of the reel in real time by mapping, with referring to the symbol array coordinate data, the symbol textures on the object of the reel defined in the virtual three-dimensional space as if the reel is visually confirmed from an opposite side of the symbol matrix display region.

According to the eleventh aspect, the object of the reel can be rendered in real time as if the symbol image of the symbol not arranged in the symbol matrix display region is visually confirmed from a side of the symbol matrix display region or an opposite side thereof in a manner to correspond to the rearranged symbols. Thus, players can be informed of the symbols arranged on the reel by visually confirming the symbols having not been arranged, for example. Therefore, a novel slot machine can be provided which allows players to enjoy new entertainability in addition to conventional entertainability.

A twelfth aspect of the present invention is a slot machine constituted as set forth below. In the tenth aspect, the controller executes the itemized (d) and the itemized (e), on condition that arrangement of one of the symbols from among the symbols displayed in the symbol matrix display region does not form the predetermined combination on the winning line.

According to the twelfth aspect, on the condition that arrangement of the symbols does not form a predetermined combination on a winning line, the symbol image of the symbol not arranged in the symbol matrix display region can be visually confirmed by displaying the reel image in a manner to correspond to the arranged symbols. Thus, players can be informed of the remaining number of frames to win a prize, by displaying the symbols having not been arranged, for example. Therefore, a novel slot machine can be provided which allows players to enjoy new entertainability in addition to conventional entertainability.

A thirteenth aspect of the present invention is a slot machine constituted as set forth below. In the tenth aspect, the slot machine further includes an input device for accepting operation input. The controller executes the itemized (d) and the itemized (e) during a period from stop of the reels in the itemized (b) to acceptance of the operation input from the input device.

According to the thirteenth aspect, during a period after stop of rotation of the reel to acceptance of operation input, the reel image can be displayed with display of the symbol image of the symbol not arranged in the symbol matrix display region in a manner to correspond to the arranged symbols. For example, during a period after stop of rotation of the reel to push of a start button, players can be informed of the symbols arranged on the reel by visually confirming the symbols not arranged. Therefore, a novel slot machine can be provided which allows players to enjoy new entertainability in addition to conventional entertainability.

A fourteenth aspect of the present invention is a slot machine including: a plurality of reels having thereon plural types of symbols set in array; a display device including both a symbol matrix display region having therein in column and row directions, the plurality of symbols set in array on the reel, and a transparent region being controllable to switch between transparent and opaque states; a driving device for pivotally moving the reel to a position where a symbol other than the symbols arranged in the symbol matrix display region can be visually confirmed; and a controller for controlling the reels, the display device, and the driving device.

The controller is programmed to: (a) execute a basic game; (b) rearrange by displaying in a scrolling manner, the plural types of symbols in the symbol matrix display region by controlling the plurality of reels during the basic game; (c) award a payout in a case where the symbols displayed in the symbol matrix display region are arranged in a predetermined combination on a winning line; (d) control the driving device so as to pivotally move the reel to the position where the symbol other than the symbols arranged in the symbol matrix display region can be visually confirmed; and (e) control to switch the transparent region to the transparent state to make visually confirmable, the symbols set in array on the reel pivotally moved to the position in the itemized (d).

According to the fourteenth aspect, the display device is rendered transparent and a position of the reel can be changed so as to make visually confirmable the symbol other than the symbols arranged in the symbol matrix display region. Thus, players can be informed of the remaining number of frames to win a prize, for example. Therefore, a novel slot machine can be provided which allows players to enjoy new entertainability in addition to conventional entertainability.

A fifteenth aspect of the present invention is a slot machine constituted as set forth below. In the fourteenth aspect, the slot machine further includes an input device for accepting operation input. The controller executes the itemized (d) and the itemized (e) during a period from stop of the reels in the itemized (b) to acceptance of the operation input from the input device.

According to the fifteenth aspect, during a period after stop of rotation of the reel to acceptance of operation input, the display device is rendered transparent and a position of the reel can be changed so as to make visually confirmable the symbol other than the symbols arranged in the symbol matrix display region. For example, during a period after stop of rotation of the reel to push of a start button, players can be informed of the symbols set in array on the reel by visually confirming the symbol not arranged. Therefore, a novel slot machine can be provided which allows players to enjoy new entertainability in addition to conventional entertainability.

A sixteenth aspect of the present invention is a slot machine including: a plurality of reels having thereon plural types of symbols set in array; a display device including both a symbol matrix display region having therein in column and row directions, the plurality of symbols set in array on the reel, and a folding region including a foldable part corresponding to at least one part of the plurality of reels; a joint for coupling the at least one of the plurality of reels to the folding region of the display device; a driving device for pivotally moving the folding region together with one of the reels to a position where a symbol other than the symbols arranged in the symbol matrix display region from among the symbols set in array on the reel can be visually confirmed; and a controller for controlling the reels, the display device, the joint, and the driving device. The controller is programmed to: (a) execute a basic game; (b) rearrange by displaying in a scrolling manner, the plural types of symbols in the symbol matrix display region by controlling the plurality of reels during the basic game; (c) award a payout in a case where the symbols displayed in the symbol matrix display region are arranged in a predetermined combination on a winning line; and (d) control the driving device so as to pivotally move the folding region of the display device to the position where the symbol other than the symbols arranged in the symbol matrix display region can be visually confirmed.

According to the sixteenth aspect, a folding region of the display device can be pivotally moved to a position where the symbol other than the symbols arranged in the symbol matrix display region can be visually confirmed. Thus, players can be informed of the remaining number of frames to win a prize by visually confirming the symbol having not been arranged, for example. Therefore, a novel slot machine can be provided which allows players to enjoy new entertainability in addition to conventional entertainability.

A seventeenth aspect of the present invention is a slot machine constituted as set forth below. In the sixteenth aspect, the slot machine further includes an input device for accepting operation input. The controller executes the itemized (d) during a period from stop of the reels in the itemized (b) to acceptance of the operation input from the input device.

According to the seventeenth aspect, during a period after stop of rotation of the reel to acceptance of operation input, a folding region of the display device can be pivotally moved to a position where the symbol other than the symbols arranged in the symbol matrix display region can be visually confirmed. Thus, players can be informed of the symbols set in array on the reel by visually confirming the symbol not arranged, during a period between stop of the rotation to push of the start button. Therefore, a novel slot machine can be provided which allows players to enjoy new entertainability in addition to conventional entertainability.

BRIEF DESCRIPTION OF THE DRAWINGS

FIG. 7 is a view showing a relationship between various symbols and payouts;

DESCRIPTION OF THE PREFERRED EMBODIMENTS

First, a slot machine 100 according to a first embodiment will be described in detail with reference to the drawings. Here, the slot machine according to the first embodiment described below is a so-called hybrid type slot machine, which has a transparent liquid crystal panel allocated in front of a plurality of mechanical reels supported in a rotatable manner, and executes a game by displaying images of various symbols drawn on an outer peripheral surface of the mechanical reels through the transparent liquid crystal panel.

Figure 1:
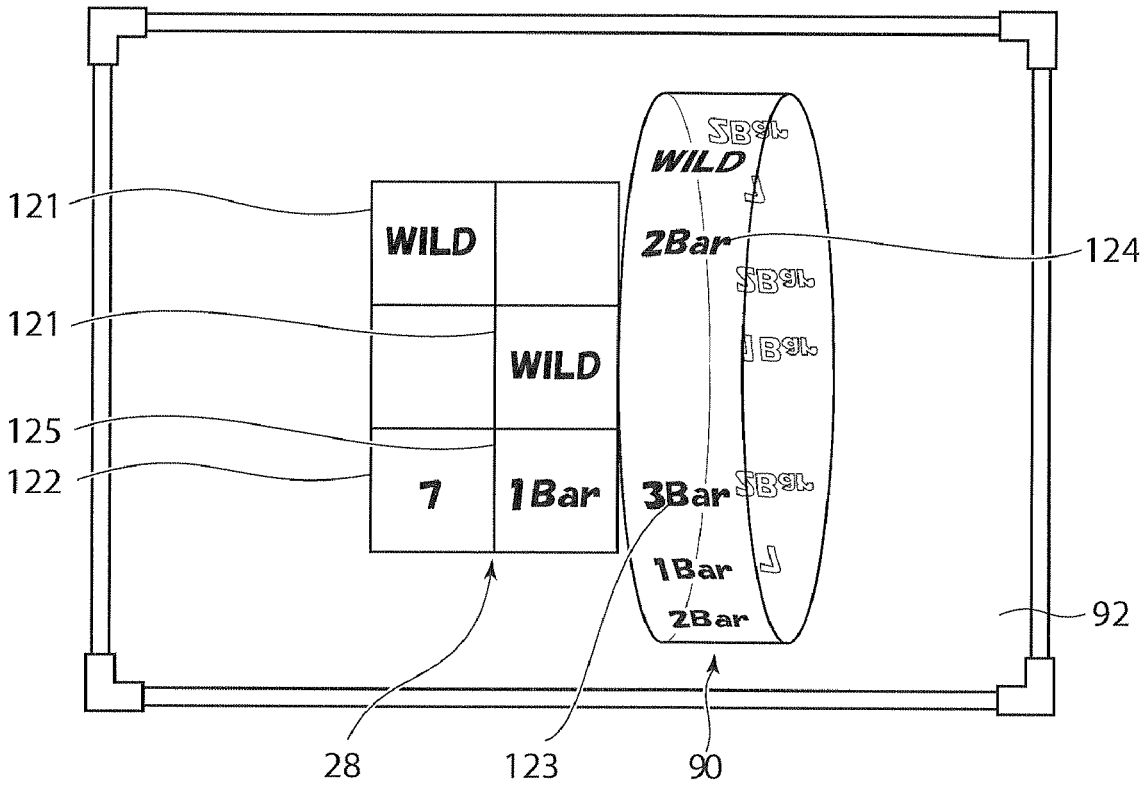
FIG. 1 is a view showing an exemplary display region displayed in a slot machine according to a first embodiment.

FIG. 1 is a view showing exemplary rearranged symbols according to the first embodiment. The basic game is executed upon consuming a gaming value corresponding to the amount bet by a player. The free game is executed without consuming a gaming value. The progressive bonus game is executed when a jackpot value reaches a predetermined progressive value. While the slot machine 100 is of a stand-alone type, which is not connected to a network, the present invention is also applicable to a networked slot machine.

In a symbol display area 28, six basic lines BL are set in the column and row directions. In the embodiments of the present invention, the basic line shall mean a winning line other than a cross line. Furthermore, two cross lines CL are set in directions that obliquely cross the symbol matrix display region 28. The eight winning lines in the embodiments of the present invention contain the basic lines BL and the cross lines CL.

In the first embodiment of the present invention, any combination of symbols "WILD" 121, "7" 122, "3Bar" 123, "2Bar" 124, "1Bar" 125, and "Blank" 126 is rearranged in the symbol matrix display region 28. In a case where the rearranged symbols form a predetermined combination on a winning line, a payout is to be awarded.

At a lower image display panel (display) 16, the symbol matrix display region 28 and a symbol image display region 90 are provided. Here, both the symbol matrix display region 28 and the symbol image display region 90 are configured as a transparent region which is controllable to switch between transparent and opaque states. In the symbol matrix display region 28, the plurality of symbols is to be arranged, which is set in array in the column and row directions on the reels 102*a* to 102*c*. The symbol image display region 90 is a region for displaying images of symbols having not been arranged in the symbol matrix display region 28, from among symbols set in array on the reel 102*c*.

The main CPU 41 controls the plurality of reels 102*a* to 102*c* so as to rearrange the plural types of symbols in the symbol matrix display region 28 while displaying them in a scrolling manner. The main CPU 41 awards a payout in a case where the symbols displayed in the symbol matrix display region 28 are arranged in a predetermined combination on a winning line. The main CPU 41 reads out of the ROM 42, reel data and symbol image data corresponding to symbols having not been arranged in the symbol matrix display region 28, from among the symbols set in array on the reel 102*c*. Based on the symbol image data and the reel data read out of the ROM 42, the main CPU 41 then generates image display data that the images of symbols are filled in a reel image in a reel shape, the symbols having not been arranged in the symbol matrix display region 28 from among symbols arranged in array on the reel 102.

Based on the generated image display data, the main CPU 41 executes a process of displaying in the symbol image display region 90, the reel image that the symbol images are filled in the reel image in the reel shape in a manner to correspond to display on the symbol matrix display region 28.

The main CPU 41 generates the image display data as if the reel 102*c* is visually confirmed from a side of the symbol matrix display region 28 or from an opposite side thereof.

Figure 2:
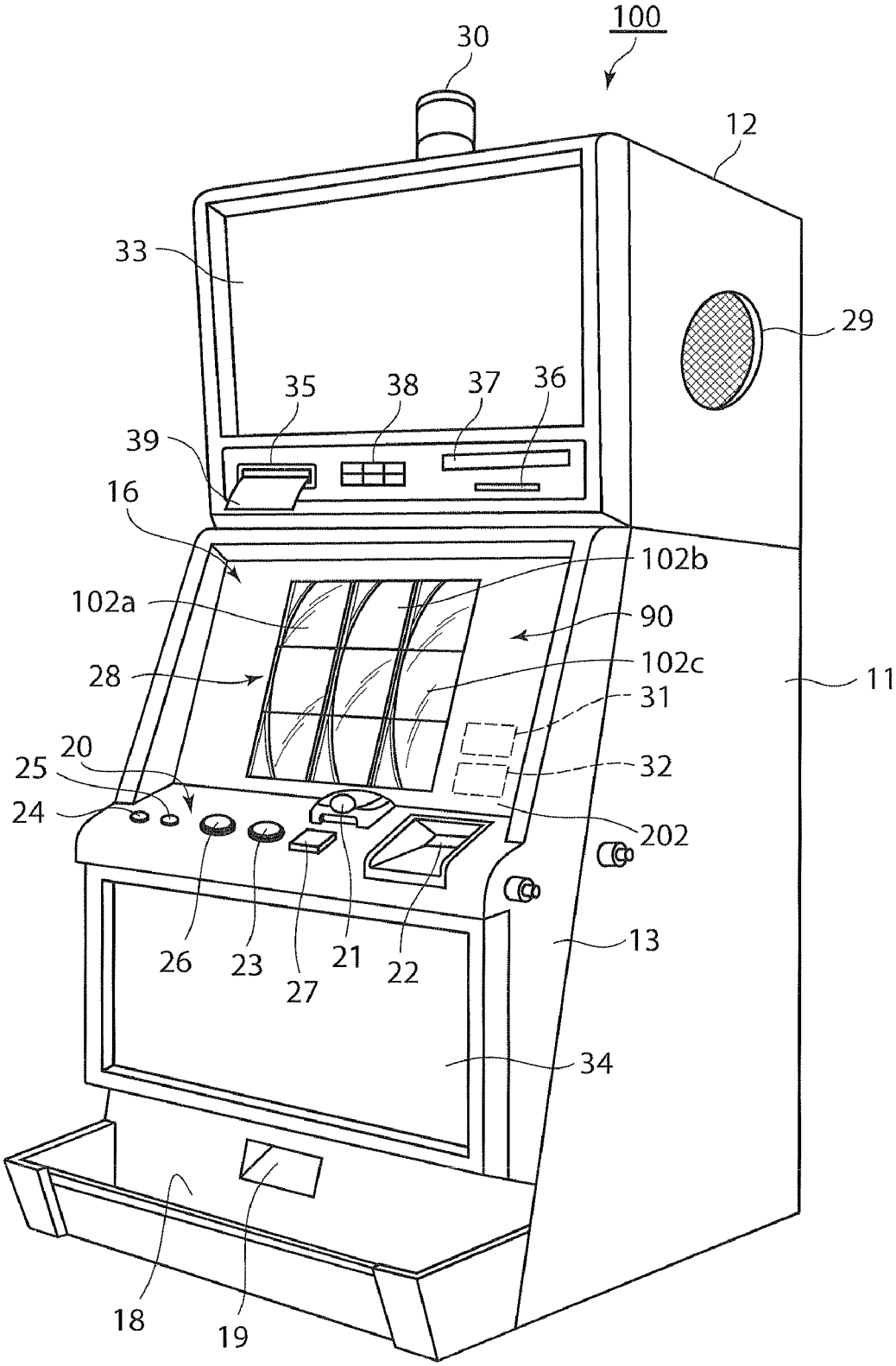
FIG. 2 is a perspective view schematically showing the slot machine according to the first embodiment.

FIG. 2 is a view schematically showing an appearance of the slot machine according to the first embodiment. The gaming media used in the slot machine 100 include coins, bills, or electronic value information equivalent thereto. In the present invention, however, medals, tokens, electronic money, or tickets, for example, may be employed as gaming mediums without being limitative thereto in particular. The above tickets are not limitative in particular, and can include barcode-attached tickets or the like, as described later, for example.

The slot machine 100 is provided with a cabinet 11, a top box 12 installed on an upper side of the cabinet 11, and a main door 13 provided on a front surface of the cabinet 11.

The lower image display panel 16 serving as a display device is provided in front of the main door 13. The lower image display panel 16 is provided with a liquid crystal display panel on which a variety of images or effect images, etc., pertinent to games are displayed during the play of the games.

Figure 3:
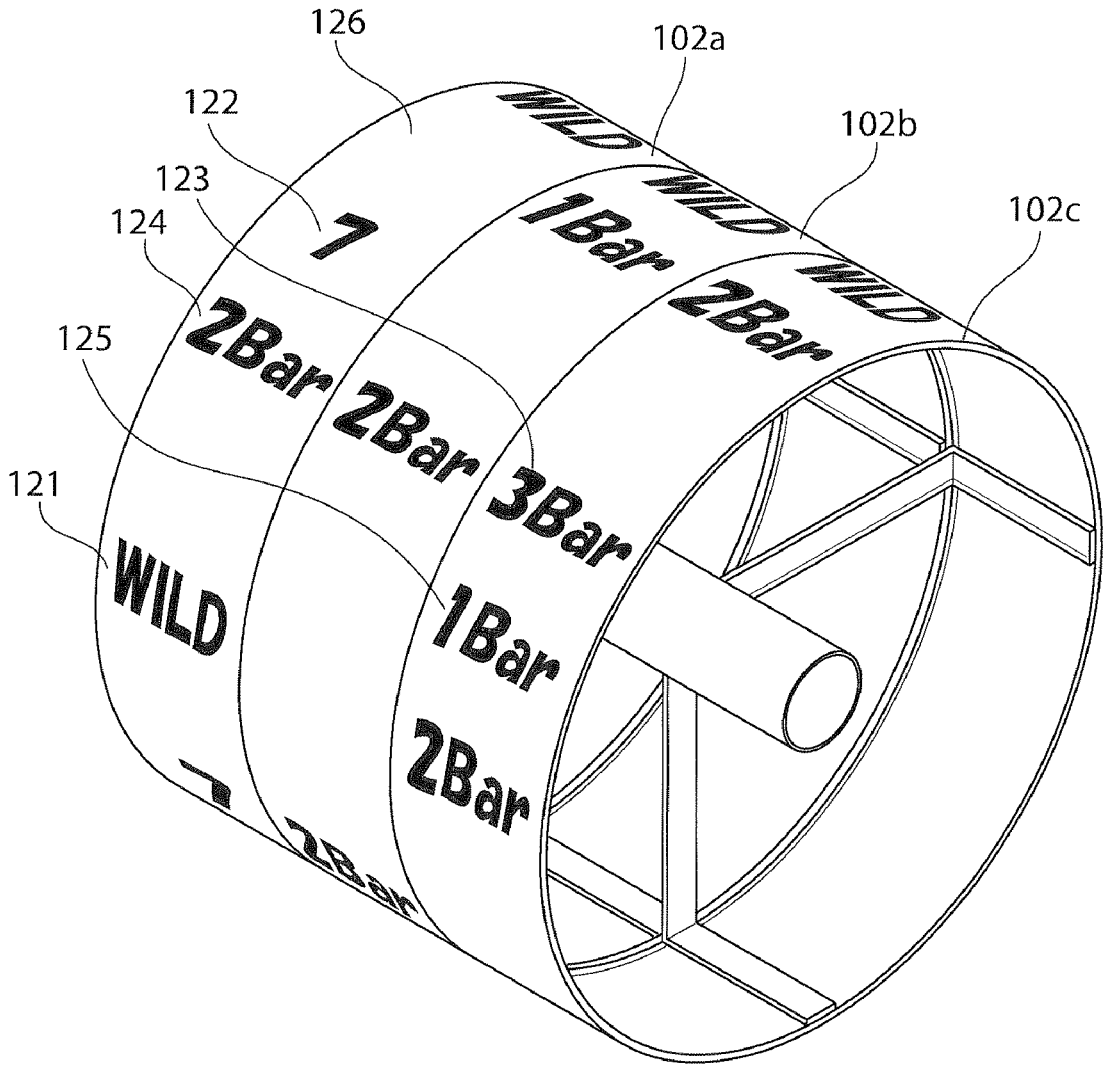
FIG. 3 is a perspective view schematically showing a reel according to the first embodiment.

At a center of the lower image display panel 16, the symbol matrix display region 28 for displaying symbols is provided. In the symbol matrix display region 28, as shown in FIG. 3, the three reels 102*a* to 102*c* are provided in a rotatable manner. On the outer peripheral surface of each of the reels 102*a* to 102*c*, the plural types of symbols "WILD" 121, "7" 122, "3Bar" 123, "2Bar" 124, "1Bar" 125 and "Blank" 126 are set in array. Any combination of the symbols "WILD" 121, "7" 122, "3Bar" 123, "2Bar" 124, "1Bar" 125 and "Blank" 126 is rearranged in the symbol display region 28 by stopping rotation of the reels 102*a* to 102*c*. Reference number 73 in FIG. 3 denotes a hinge described with reference to FIGS. 14 and 15.

Winning lines are set in the lower image display panel 16. The winning lines includes the six basic lines BL which are set in the column and row directions of the symbol matrix display region 28, and the two cross lines CL which diagonally cross the symbol display region 28. The basic lines BL and the cross lines CL as winning lines are to define a combination of symbols.

A credit amount display unit 31 of the lower image display panel 16 displays the number of coins credited by way of an image. A payout amount display unit 32 displays by way of an image the number of coins to be paid in a case where a predetermined combination of symbols are rearranged on the winning line.

Downwardly of the lower image display panel 16, a control panel 20 consisting of a plurality of buttons 23 to 27 for entering instructions pertinent to the progress of a game by a player; a coin insertion slot 21 for accepting coins in the cabinet 11; and a bill validator 22 are provided.

On the control panel 20, a start button 23, a change button 24, a cashout button 25, a 1-BET button 26, and a max-BET button 27 are provided. The start button 23 is intended for entering a command for starting the game. The change button 24 is intended for use in asking an attendant of the gaming facility for change. The cashout button 25 is intended for entering a command for paying the credited coins to a coin tray 18 through a coin payout exit 19.

The 1-BET button 26 is intended for entering a command for betting one coin among the credited coins on the game. The max-BET button 27 is intended for entering a command for betting the upper number (fifty in this embodiment) of coins that can be bet per game among the credited coins on the game.

The bill validator 22 validates whether or not a bill is legitimate and accepts a legitimate bill into the cabinet 11. The bill validator 22 may be configured so that a barcode-attached ticket 39 described later is readable thereby. Provided on a lower front surface of the main door 13, that is, at a lower part of the control panel 20, is a berry glass 34 on which characters of the slot machine 10 and the like are depicted.

On the front face of the top box 12, an upper image display panel 33 is provided. The upper image display panel 33 has a liquid crystal panel, which displays images for introducing the game contents or explaining game rules, for example.

Also, on the top box 12, a lamp 30 and a speaker 29 are provided. At the lower side of the upper image display panel 33, a ticket printer 35, a card reader 36, a data display 37, and a keypad 38 are provided. The ticket printer 35 prints, on tickets, bar codes containing coded data such as credit amount, date and time, or ID numbers of the slot machine 10, and the bar code-attached tickets 39 are output. A player causes another slot machine to read the bar-code-attached tickets 39, allowing the slot machine to perform games, or alternatively, allowing the exchange of bar-code-attached tickets 39 with bills or the like at a predetermined site of a game facility (for example, at the casher in a casino).

The card reader 36 reads data from and writes data into a smart card. The smart card is to be owned by the player, which stores data for identifying the player or data regarding the log of games executed by the player, for example. The smart card may store data equivalent to coins, bills, or credits. Furthermore, as an alternative of a smart card, a magnetic stripe card may be employed. The data display 37 is made up of a fluorescent display or the like, and stores data read by the card reader 36 or data input by a player via the keypad 38, for example. The keypad 38 is intended for entering the instructions or data pertinent to the issuance of tickets.

Figure 4:
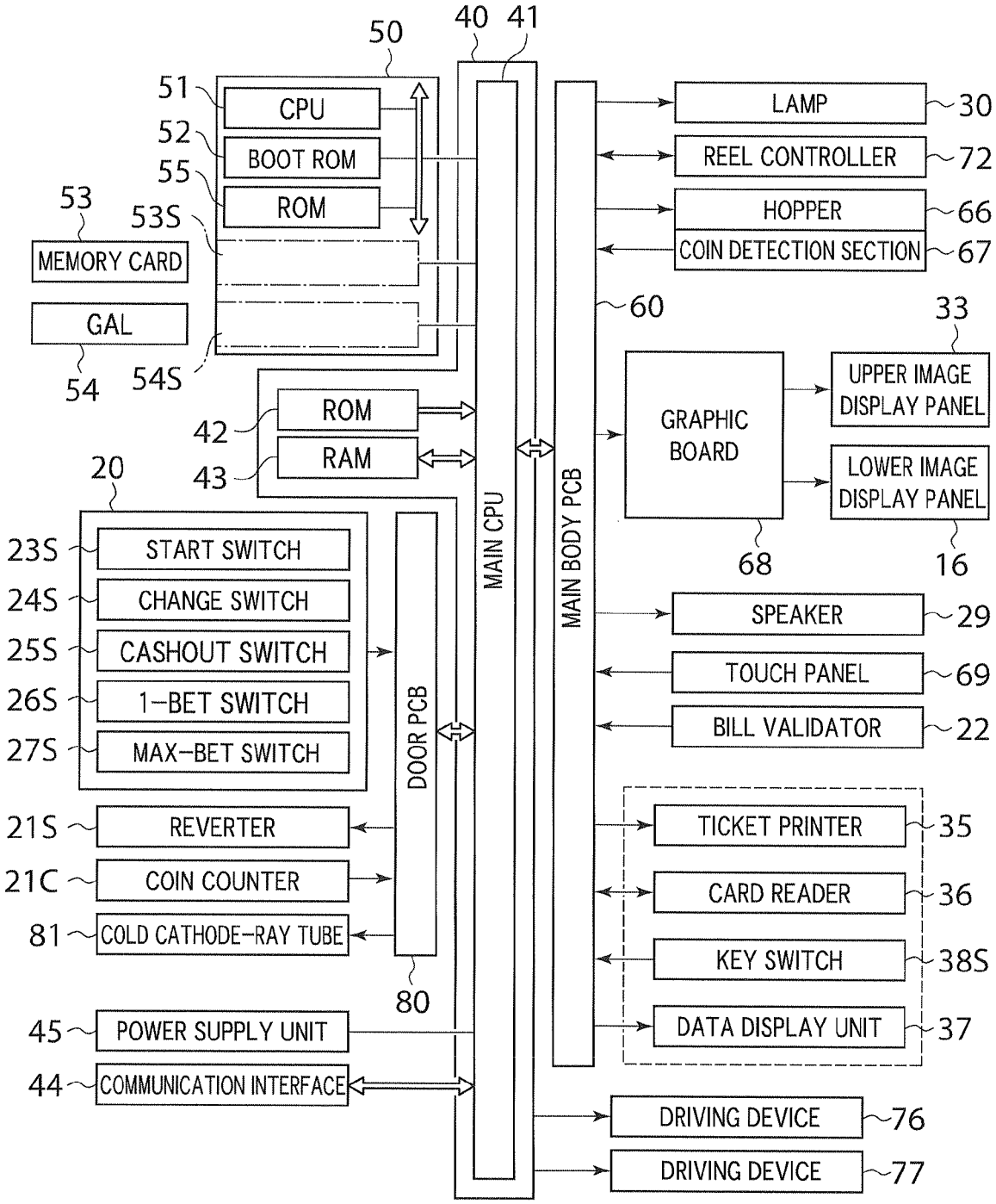
FIG. 4 is a view showing an internal construction of the slot machine shown in FIG. 2.

FIG. 4 is a block diagram depicting the internal construction of the slot machine shown in FIG. 2. A gaming board 50 includes: a CPU (Central Processing Unit) 51, a ROM (Read Only Memory) 55 and a boot ROM 52 interconnected by an internal bus; a card slot 53S corresponding to a memory card 53; and an IC socket 54S corresponding to a GAL (Generic Array Logic) 54.

A memory card 53 is composed of a non-volatile memory, such as CompactFlash®, and stores a game program. The game programs include a symbol selection program. The aforementioned symbol selection program is intended for determining the symbols to be rearranged in the elements of the symbol matrix SM. The symbol selection program includes symbol weighing data corresponding to each of a plurality of kinds of payout ratios (for example, 80%, 84%, and 88%). The symbol weighing data is indicative of the correspondence relationship between a code number of each of symbols (see FIG. 6) and one or more random number values which come under a predetermined numerical range (0 to 256), with respect to each of the reels 102*a* to 102*c*. The payout ratio is determined according to the payout-ratio setting data output from the GAL 54. The symbols to be stopped and displayed are determined depending upon the symbol weighing data corresponding to this payout ratio.

Also, the card slot 53S is configured to allow the memory card 53 to be inserted thereinto or ejected therefrom, and is connected to a motherboard 40 through an IDE bus. Accordingly, the memory card 53 can be ejected from the card slot 53S, other game programs and other game system programs can then be written into the memory card 53, and further, the memory card 53 can be inserted into the card slot 53S, thereby allowing the player to change the types and contents of games executed in the slot machine 10. The game program includes programs concerning a game progress. The game programs include those which are relevant to the operating procedures for performing games. Furthermore, the game program includes image data or sound data to be output during the game. The image data include, for example, image data indicative of the symbol matrix.

The GAL 54 is a kind of PLD having an OR-fixed arrayed structure. The GAL 54 is provided with a plurality of IN ports and OUT ports. If predetermined items of data are input to the IN port, the corresponding data is output from the OUT port. The data output from the OUT port is equivalent to the above-described payout rate setting data. In addition, an IC socket 54S is constituted to allow removable insertion of the GAL 54, and is connected to a motherboard 40 by means of a PCI bus. Further, the GAL is replaced with the replacement GAL 54, thereby making it possible to vary the payout rate setting data.

The CPU 51, the ROM 55, and the boot ROM 52 interconnected by the internal bus are connected to the motherboard 40 by the PCI bus. The PCI bus serves to transmit signals between the motherboard 40 and the gambling board 50 and supply power from the motherboard 40 to the gaming board 50.

The motherboard 40 is constructed using a general-purpose motherboard commercially available (a printed circuit board on which essential parts of a personal computer are mounted) and includes: a main CPU 41, a ROM (Read Only Memory) 42; a RAM (Random Access Memory) 43; and a communication interface 44. In embodiments of the present invention, the main CPU 41 controls especially the lower image display panel 16, the reels 102*a* to 102*c*, the ROM 42, the RAM 43, the driving devices 76, 77, and the like.

The ROM 42 is made up of a memory device such as a flash memory, and stores a program such as a BIOS (Basic Input/Output System) executed by the main CPU 41 and permanent data. When the BIOS is executed by the main CPU 41, processing of initializing predetermined peripheral devices is carried out and processing of capturing game programs and game system programs stored in the memory card 53 through the gaming board 50 is started. In the present invention, the contents of the ROM 42 may be rewritable or not. This ROM (memory) 42 stores reel image data and image data relating to symbols identical or similar to the plural types of symbols set in array on the reel 102*c*. Specifically, the ROM 42 stores frontside and backside symbol textures identical or similar to the plural types of symbols set in array on the reel; object data of a reel defined in a virtual three-dimensional space; and symbol array coordinate data to map the frontside and backside symbol textures on an object of the reel defined in the virtual three-dimensional space in a manner similar to symbol array on the reel. The symbol array coordinate data is data to set the symbol textures in array on the reel object in a manner similar to symbol array on the mechanical reel 102. Use of this symbol array coordinate data makes it possible to map the symbol textures on the reel object in a manner similar to the symbol array drawn on the reel 102*c*.

The RAM 43 stores data and programs used when the main CPU 41 is activated. The RAM 43 can also store game programs. Further, the RAM 43 stores the data of credit amounts and coin insertion numbers or payout numbers in one game.

To the motherboard 40, a main body PCB (Printed Circuit Board) 60 and a door PCB 80, described later, is interconnected by means of a USB. A power Supply unit 45 is also connected to the motherboard 40.

To the main body PCB 60 and the door PCB 80, equipment or devices, for generating an input signal to be input to the main CPU 41, and those of which operation is controlled by means of a control signal output from the main CPU 41, are connected. The main CPU 41 executes the game programs stored in RAM 43, based upon an input signal that was input to the main CPU 41, thereby performing predetermined computational processing. Then, this CPU 41 stores results thereof into RAM 43; and transmits control signals to equipment and devices as control processing relative to the equipment and devices.

To the main body PCB 60, a lamp 30, a reel controller 72, a hopper 66, a coin detection section 67, a graphic board 68, a speaker 29, a touch panel 69, a bill validator 22, a ticket printer 35, a speaker 29, a touch panel 69, a bill validator 22, a ticket printer 35, a card reader 36, a key switch 38S, and a data display 37 are connected. The lamp 30 lights in a predetermined pattern, based upon a control signal output from the main CPU 41.

Figure 5:
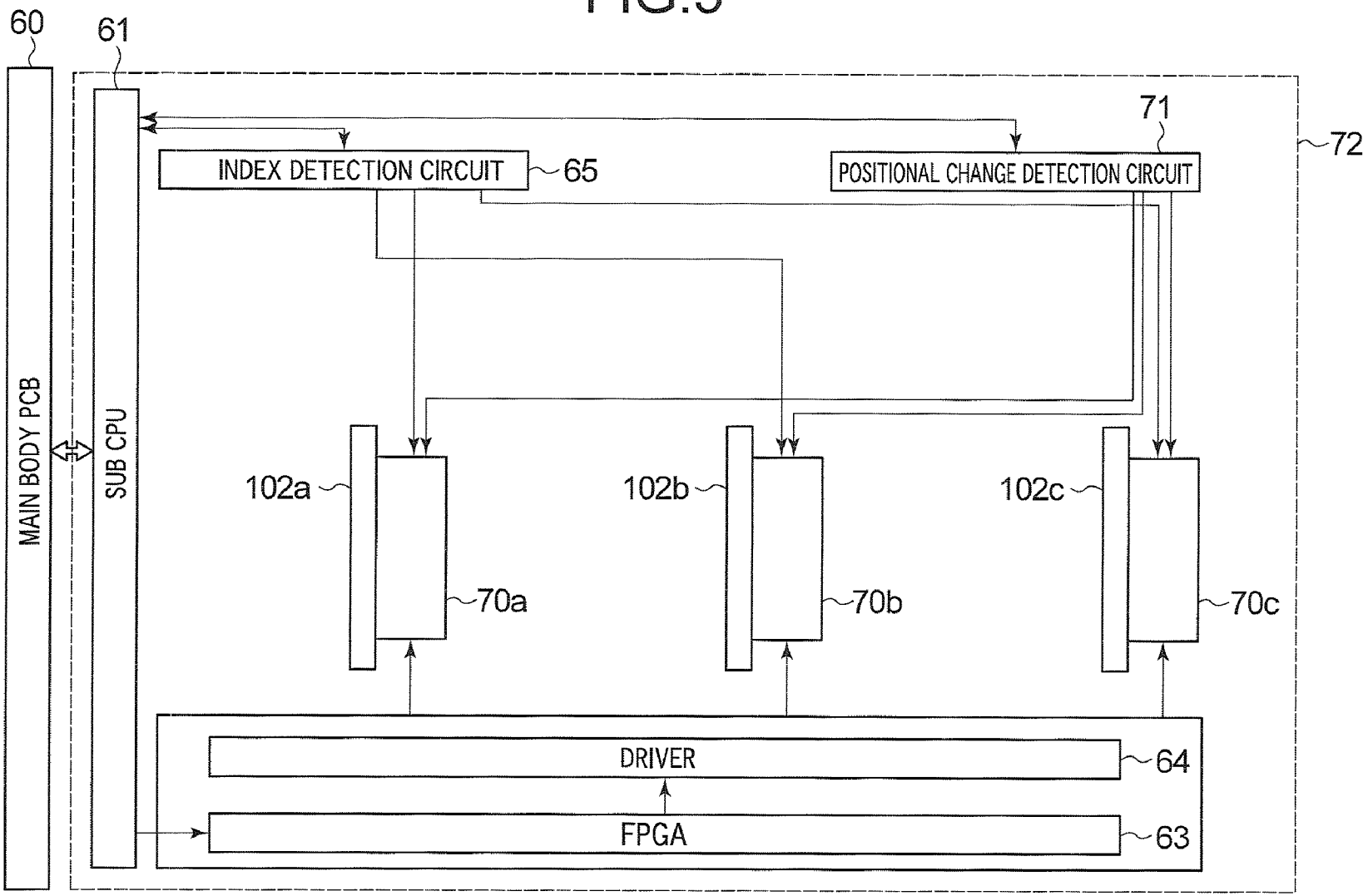
FIG. 5 is a view showing an internal construction of the reel shown in FIG. 4.

As shown in FIG. 5, a sub CPU 61 included in the reel controller 72 controls rotation and stop of the reels 102*a* to 102*c*. A motor driving circuit 62, which is provided with an FPGA (Field Programmable Gate Array) 63 and a driver 64, is connected to the sub CPU 61. The FPGA 63 is an electronic circuit such as a programmable LSI, and functions as a control circuit of stepping motors 70. The driver 64 functions as an amplifier circuit of a pulse input into the stepping motors 70. The stepping motors 70*a* to 70*c* for rotating the reels 102*a* to 102*c* respectively are connected to the motor driving circuit 62. Each of the stepping motors 70 is a 1-2 phase-excitation type stepping motor.

Further, the sub CPU 61 is connected to an index detection circuit 65 and a positional change detection circuit 71. The index detection circuit 65 detects positions (indices described later) of the rotating reels 102*a* to 102*c*, and further, is capable of detecting step-out of any of the reels 102*a* to 102*c*.

The positional change detection circuit 71 detects a change of a stop position of the reels 102*a* to 102*c* after stop of rotation thereof. For example, the positional change detection circuit 71 detects change in position where the reels 102*a* to 102*c* are stopped, in a case where a player forcibly changes positions of the reels in which a winning combination is actually not established, to the positions at which the symbols form a winning combination. The positional change detection circuit 71 is constituted so that the change in the stop position of the reels 102*a* to 102*c* can be detected by detecting fins (not shown) mounted to the insides of the reels 102*a* to 102*c* at predetermined intervals.

The hopper 66 is installed in a cabinet 11, and a predetermined number of coins are paid out from the coin payout opening 19 to the coin tray 18, based upon the control signal output from the main CPU 41. A coin detection section 67 is provided inside of the coin payout opening 19, and outputs an input signal to the main CPU 41, if it is detected that a predetermined number of coins have been paid out from the coin payout opening 19.

A graphic board 68 controls the images to be displayed on the upper and lower image display panels 33, 16, based upon the control signal output from the main CPU 41. The credit amount display section 31 (see FIG. 2) on the lower image display panel 16 displays the number of credits stored in the RAM 43. Further, the payout amount display section 31 (see FIG. 2) on the lower image display panel 16 displays the number of coins to be paid out. The graphic board 68 is provided with: a VDP (Video Display Processor), which generates image data, based upon the control signal output from the main CPU 41; and a video RAM, etc., which temporarily stores image data generated by the VDP. The image data used when the image data is generated by the VDP is read from the memory card 53, and thereafter, is included in the game programs stored in the RAM 43.

The bill validator 22 validates whether or not a bill is legitimate and accepts a legitimate bill into the cabinet 11. The bill validator 22, upon accepting a legitimate bill, outputs an input signal to the main CPU 41 based on the bill amount. The main CPU 41 stores in the RAM 43, the amount of credits responsive to the amount of bills transmitted by the input signal.

Based on a control signal output from the main CPU 41, the ticket printer 35 prints on a ticket a barcode having encoded thereon data such as the credit amount, data and time, and the identification number of the slot machine 10 stored in the RAM 43. Further, this printer outputs the printed ticket as a barcode-attached ticket 39. The card reader 36 reads data from a smart card, thereby transmitting the read data to the main CPU 41 or writing data into the smart card, based upon the control signal from the main CPU 41. The key switch 38S is provided on the key pad 38, and outputs a predetermined input signal to the main CPU 41 when a player operates the key pad 38. The data display 37 displays, based upon a control signal output from the main CPU 41, the data read by the card reader 36 and the data input by a player through the key pad 38.

A control panel 20, a reverter 21S, a coin counter 21C, and a cold cathode-ray tube 81 are connected to the door PCB 80. The control panel 20 is provided with: a start switch 23S corresponding to the start button 23; a change switch 24S corresponding to the change button 24; a cashout switch 25S corresponding to a cashout button 25; a 1-BET switch 26S corresponding to a 1-BET button 26; and a MAX-BET switch 27S corresponding to the MAX-BET button 27. When the player operates the buttons 23 to 27, the corresponding switches 23S to 27S output input signals to the main CPU 41, respectively.

The coin counter 21C is provided inside the coin receiving slot 21, and validates whether or not a legitimate coin is inserted into the coin receiving slot 21. Those other than the legitimate coins are discharged from the coin payout exit 19. The coin counter 21C outputs an input signal to the main CPU 41 when a legitimate coin is detected.

The reverter 21S is operable based upon the control signal output from the main CPU 41. This reverter distributes the coins recognized to be legitimate by the coin counter 21C, into a cashbox (not shown) or a hopper 66 which was installed in the slot machine 10. In other words, if the hopper 66 is filled with coins, the legitimate coins are distributed to the cashbox by means of the reverter 21S. Otherwise, the legitimate coins are distributed to the hopper 66. The cold cathode-ray tube 81 functions as a backlight installed at the rear side of the lower and upper image display panels 16 and 33, and lights based upon the control signal that was output from the main CPU 41.

Figure 6:
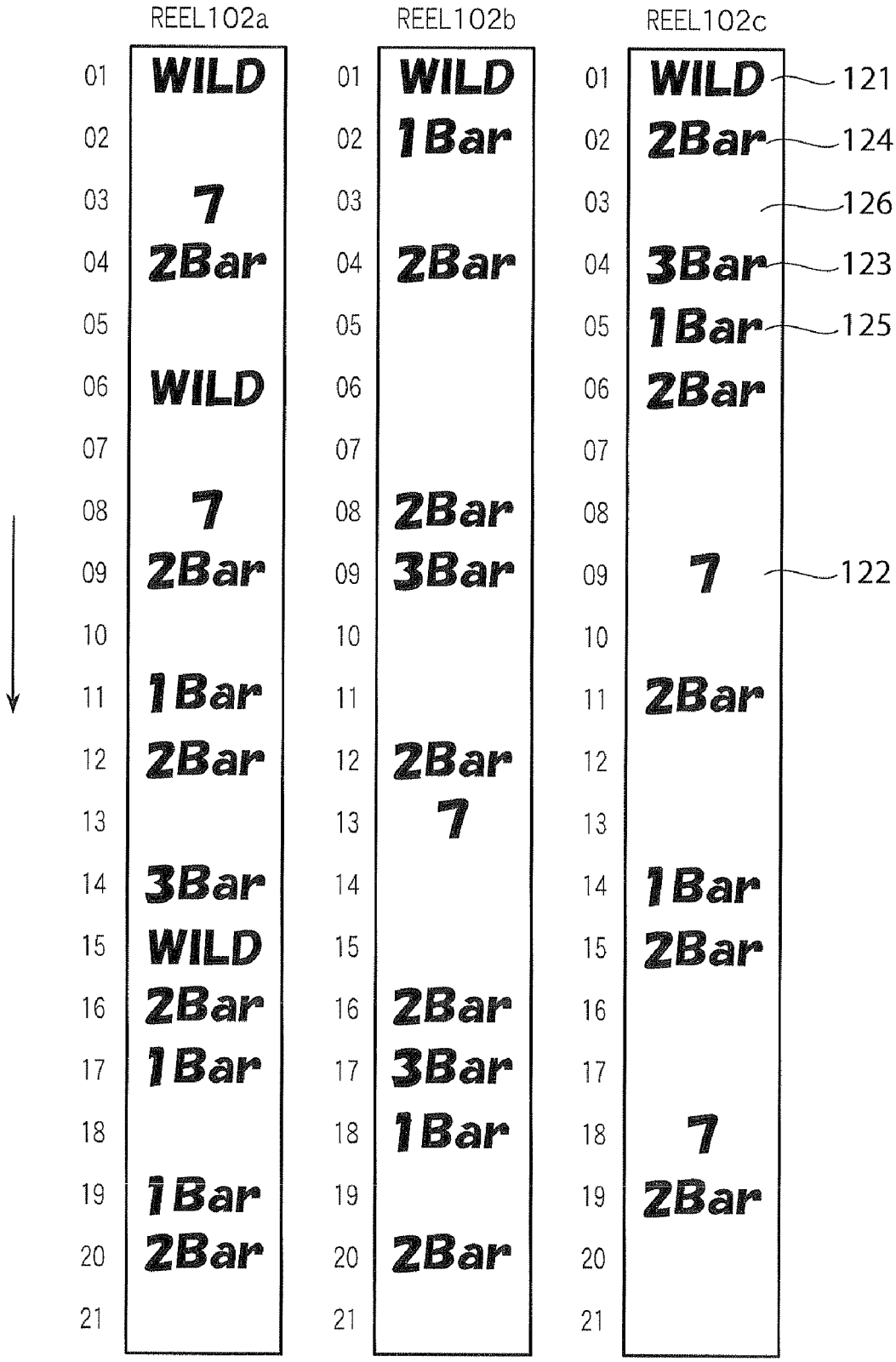
FIG. 6 is a view showing exemplary symbols set in array on reels according to the first embodiment.

FIG. 6 is a view showing exemplary symbols set in array on the reels according to the first embodiment. As shown in FIG. 6, a symbol array is arranged, which consists of the twenty-one symbols of plural types, on each of outer peripheries of the reels 102*a* to 102*c*. Code numbers from "01" to "21" are assigned to the symbols, respectively, and these numbers are stored as a data table in the ROM 42 (see FIG. 4). On each of the outer peripheries of the reels 102*a* to 102*c*, the symbol array including the symbols "WILD" 121, "7" 122, "3Bar" 123, "2Bar" 124, "1Bar" 125, and "Blank" 126 is arranged. The reels 102*a* to 102*c* are rotationally driven so as to shift the symbol arrays in a direction indicated by an arrow in FIG. 6.

FIG. 7 is a view showing a correspondence relationship between various symbols and payouts. As shown in FIG. 6, where a predetermined symbol is rearranged on a winning line on which the player has bet, a payout is determined based on a winning combination. Here, a payout is to be obtained in a case where the symbols form any one of winning combinations "WILD-WILD-WILD", "7-7-7", "3 Bar-3 Bar-3Bar", and "2 Bar-2 Bar-2Bar", "1Bar-1Bar-1Bar" on any one of the basic lines BL and cross lines CL as winning lines set in the symbol display region 28. Further, in a case where the symbols are rearranged in a combination "WILD-WILD-WILD" on a winning line, a payout of "200" is to be obtained and the game is shifted to a bonus game. The bonus game is offered after execution of the basic game or the free game. The bonus game is generally favorable to the player.

Figure 8A:
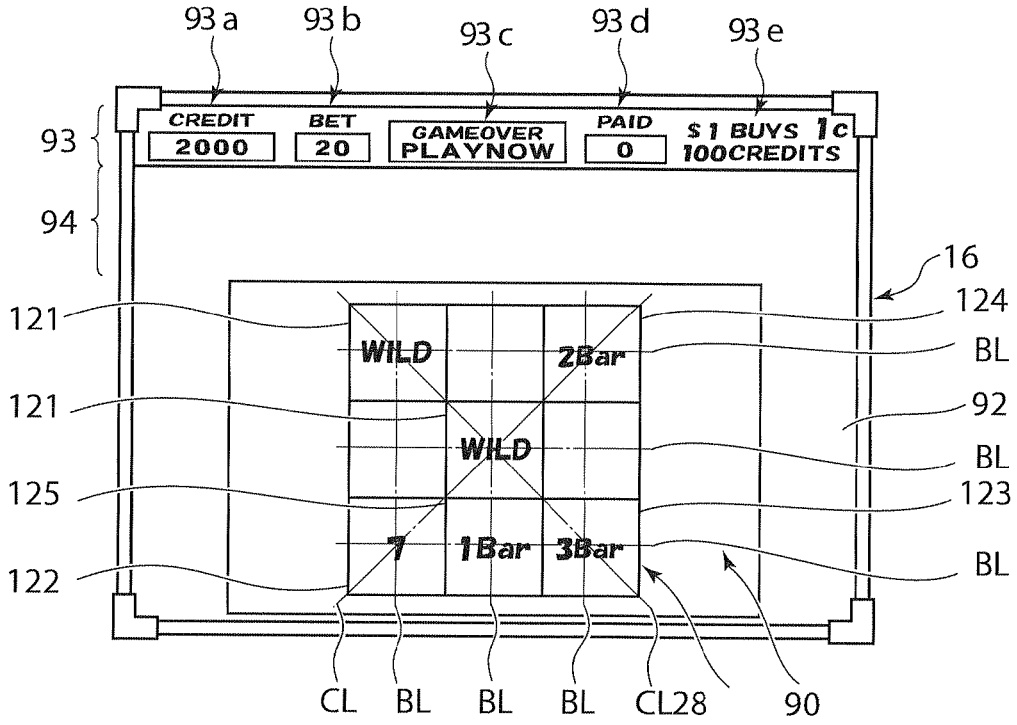
FIG. 8A is a view showing an exemplary image displayed on a lower image display panel of the slot machine according to the first embodiment.
Figure 8B:
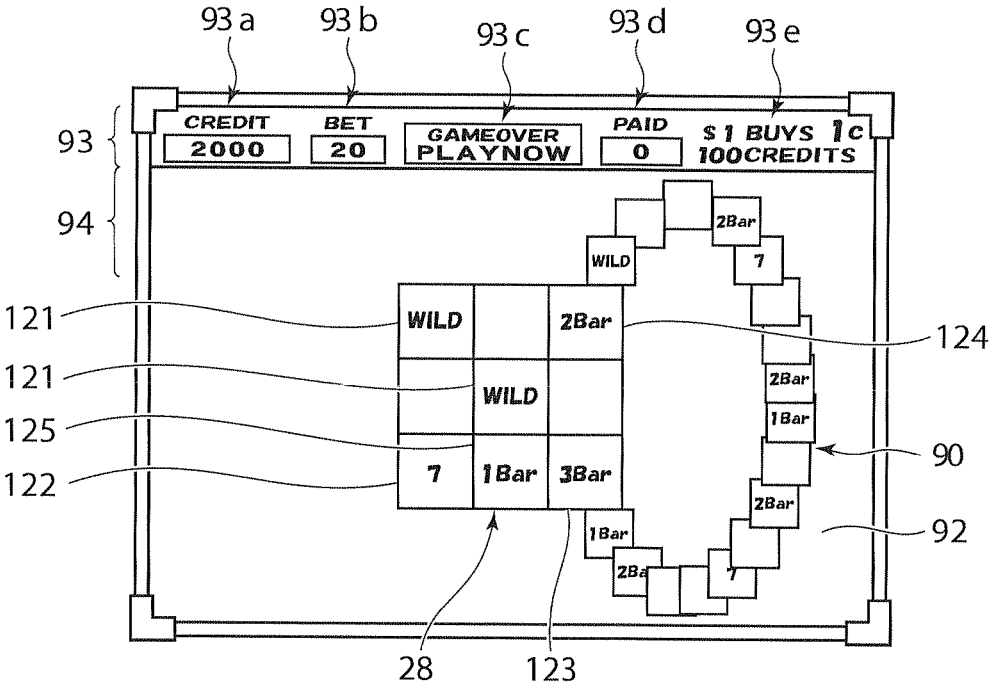
FIG. 8B is a view showing an exemplary image displayed on the lower image display panel of the slot machine according to the first embodiment.

FIGS. 8A and 8B are views each showing an exemplary image displayed in the slot machine shown in FIG. 2 according to the first embodiment. As shown in FIG. 8A, the lower image display panel 16 is made up of a display region 92, an information display section 93, an effect image display section 94, and the like. The display area section 92 is for displaying a symbol matrix region 28. In addition, the information display section 93 is arranged above the display area section 92. This display section is made up of a credit amount display section 93*a*, a BET amount display section 93*b*, a character information display portion 93*c*, a PAID amount display section 93*d*, and a charge display section 93*e*.

The number of coins presently credited is displayed at the credit amount display section 93*a* while the number of coins bet in one game is displayed at the BET amount display section 93*b*. The character information indicative of a current status of the game is displayed at the character information display section 93*c*. The characters of "PLAYNOW" are displayed during the play of the game, whereas the characters of "GAMEOVER" are displayed during the intervals between the plays of the game. The number of coins that has been successfully obtained in one game is displayed at the PAID amount display section 93*d*, whereas a conversion value of the credit amount based on a predetermined charge is displayed at the charge display section. At the effect image display section 94, effect images in accordance with a type of the present slot game are displayed.

Any of the symbols "WILD" 121, "7" 122, "3Bar" 123, "2Bar" 124, "1Bar" 125, and "Blank" 126 are rearranged in the symbol matrix display region 28 displayed on the lower image display panel 16. In a case where the rearranged symbols form a predetermined combination on a winning line, a payout is to be awarded.

FIG. 8A shows the case where a combination of the symbols displayed in the symbol matrix display region 28 is not a predetermined one on a winning line. In this case, from among the symbols set in array on the reel 102*c*, images of symbols not arranged in the symbol matrix display region 28 are displayed by filling them in a reel image in a reel shape. Three reels 102*a* to 102*c* are rotatably provided in the symbol matrix display region 28. In the symbol display area 28, the six basic lines BL are set in the column and row directions. In the embodiments of the present invention, the basic line shall mean a winning line other than a cross line. Furthermore, the two cross lines CL are set in directions that obliquely cross the symbol matrix display region 28.

Figure 9A:
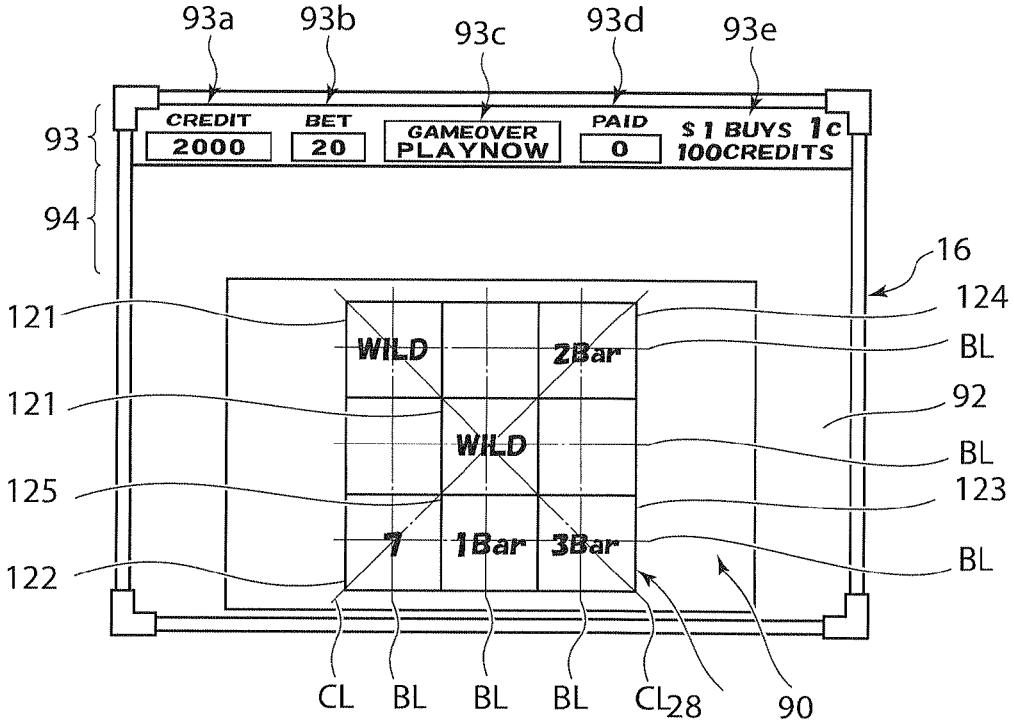
FIG. 9A is a view showing an exemplary image displayed on the lower image display panel of the slot machine according to the first embodiment.
Figure 9B:
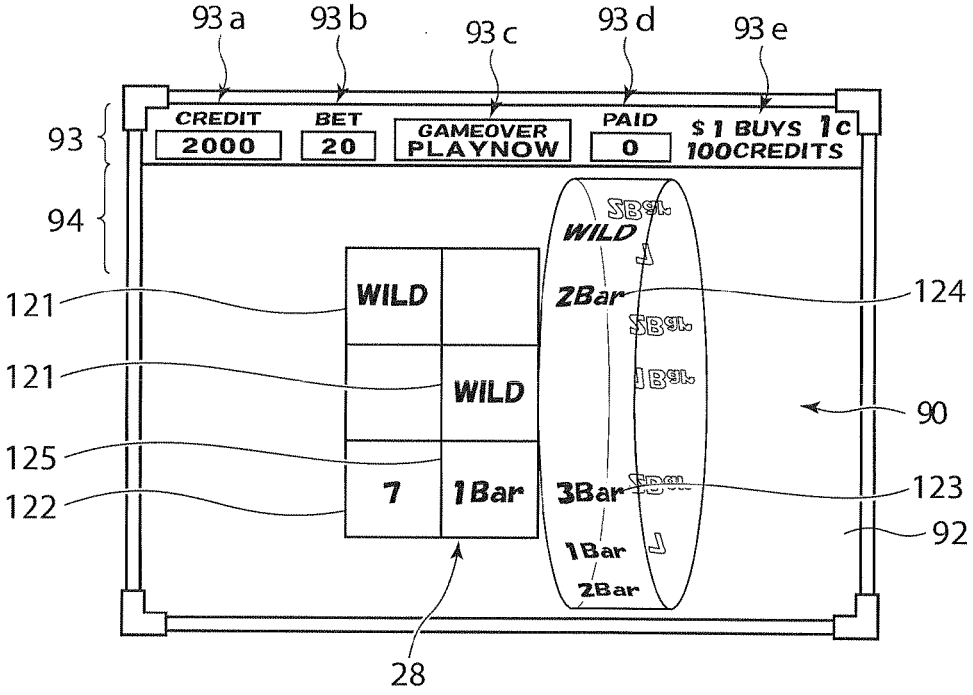
FIG. 9B is a view showing an exemplary image displayed on the lower image display panel of the slot machine according to the first embodiment.

FIGS. 9A and 9B are views each showing an exemplary image displayed in the slot machine shown in FIG. 2 according to the first embodiment. As shown in FIG. 9A, any combination of symbols "WILD" 121, "7" 122, "3Bar" 123, "2Bar" 124, "1Bar" 125, and "Blank" 126 is rearranged in the symbol matrix display region 28. In a case where a combination of the symbols arranged in the symbol matrix display region 28 is not a predetermined one on a winning line, from among the symbols set in array on the reel 102*c*, images of the symbols not arranged in the symbol display region 28 are displayed by filling them in the reel image in the reel shape, as shown in FIG. 9B. In FIG. 9B, the reel 102*c* displays the reel images in the symbol image display region 90 as if the reel 102*c* is visually confirmed from a side of the symbol matrix display region 28.

Figure 10A:
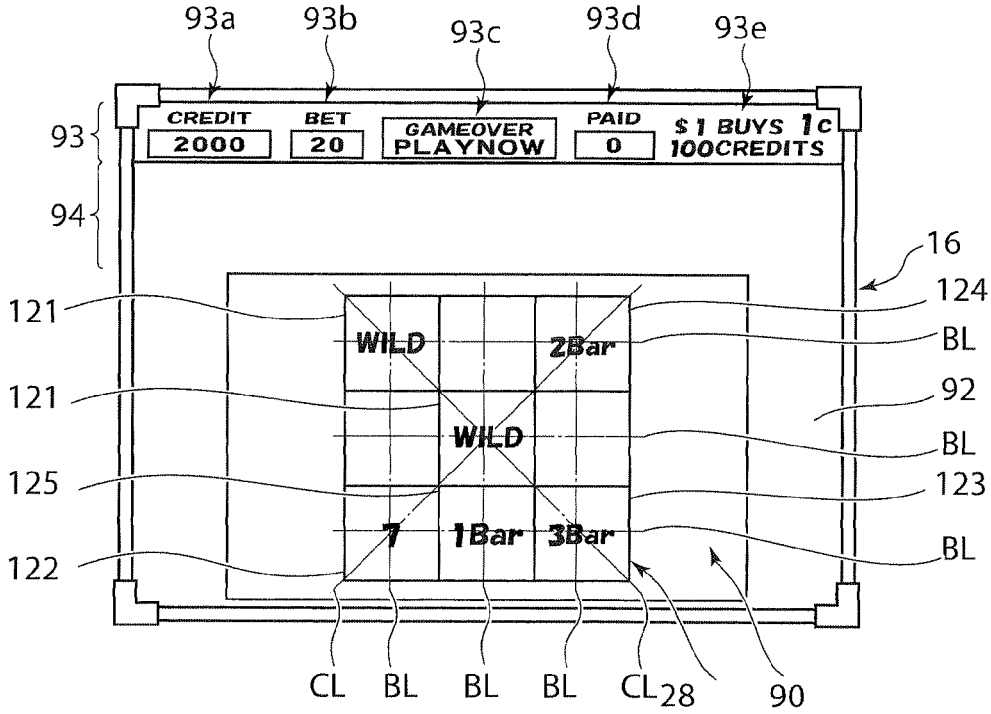
FIG. 10A is a view showing an exemplary image displayed on the lower image display panel of the slot machine according to the first embodiment.
Figure 10B:
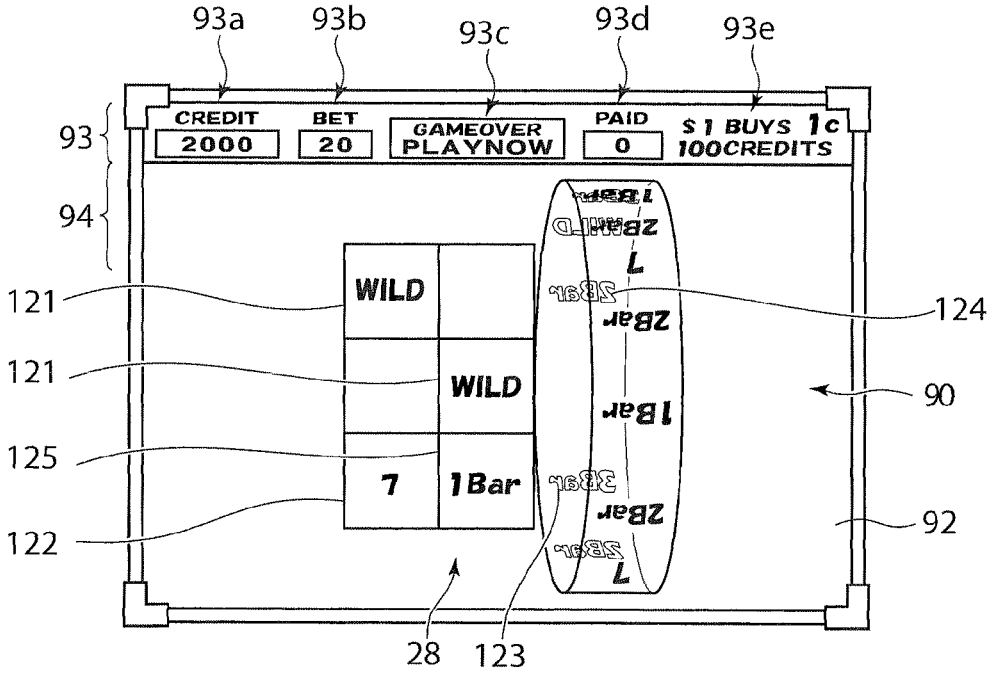
FIG. 10B is a view showing an exemplary image displayed on the lower image display panel of the slot machine according to the first embodiment.

FIGS. 10A and 10B are views each showing an exemplary image displayed in the slot machine shown in FIG. 2 according to the first embodiment. As shown in FIG. 10A, any combination of symbols "WILD" 121, "7" 122, "3Bar" 123, "2Bar" 124, "1Bar" 125, and "Blank" 126 is rearranged in the symbol matrix display region 28. In a case where a combination of the symbols displayed in the symbol matrix display region 28 is not a predetermined one on a winning line, from among the symbols set in array on the reel 102*c*, images of symbols not arranged in the symbol matrix display region 28 are displayed by filling them in the reel image in a reel shape, as shown in FIG. 10B. In FIG. 10B, the reel images are reversed and displayed in the symbol matrix display region 90 as if the reel 102*c* is visually confirmed from an opposite side of the symbol matrix display region 28.

Next, a process executed in the slot machine 10 according to the first embodiment will be described in detail with reference to the accompanying drawings. The main CPU 41 reads out and executes a game program, thereby conducting the game.

Figure 11:
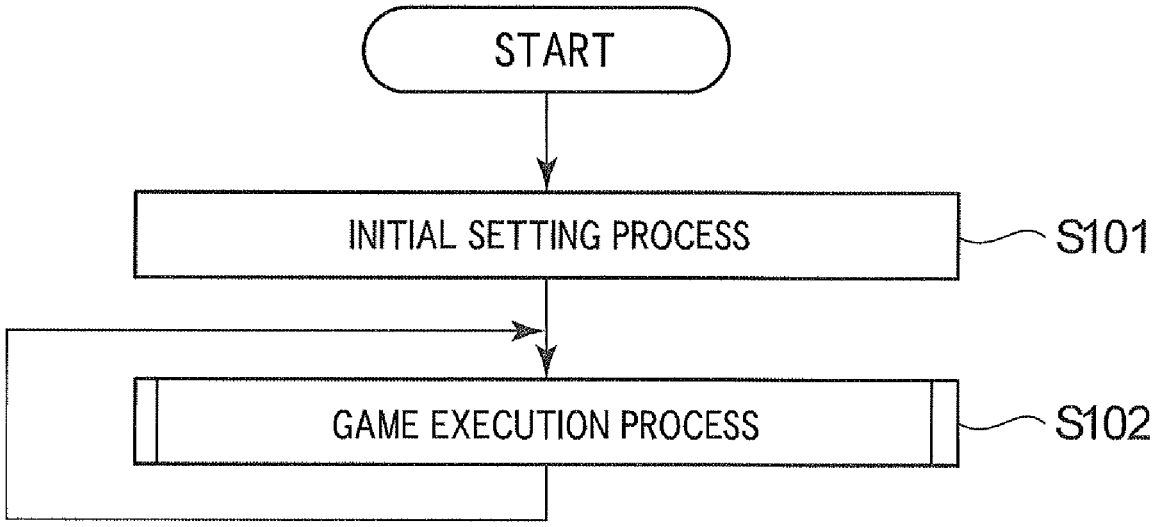
FIG. 11 is a flowchart showing a subroutine of a main process.

FIG. 11 is a flowchart showing a subroutine of the main process. In the main process, first, when a power switch is turned on (that is, when power is supplied), a motherboard 40 and a gaming board 50 are activated respectively, so that the CPU 51 executes an initial setting process (step S101). In this initial setting process, the main CPU 41 executes the BIOS stored in the ROM 42, decompresses, in the RAM 43, compressed data included in the BIOS, executes the BIOS decompressed in the RAM 43, and performs diagnosis and initialization of each of the peripheral devices. Further, the main CPU 41 writes game programs or the like from the ROM 42 into the RAM 43, and acquires payout-ratio setting data and country-identification information. The main CPU 41 also performs an authentication process for each program during execution of the initial setting process.

Next, the main CPU 41 performs a game execution process described later with reference to FIG. 12 (step S102). In this game execution process, the main CPU 41 sequentially reads and executes the game programs or the like from the ROM 42. By performing this game execution process, the slot machine 10 executes the game according to the first embodiment. The game execution process is repeatedly performed while power is supplied to the slot machine 10.

Figure 12:
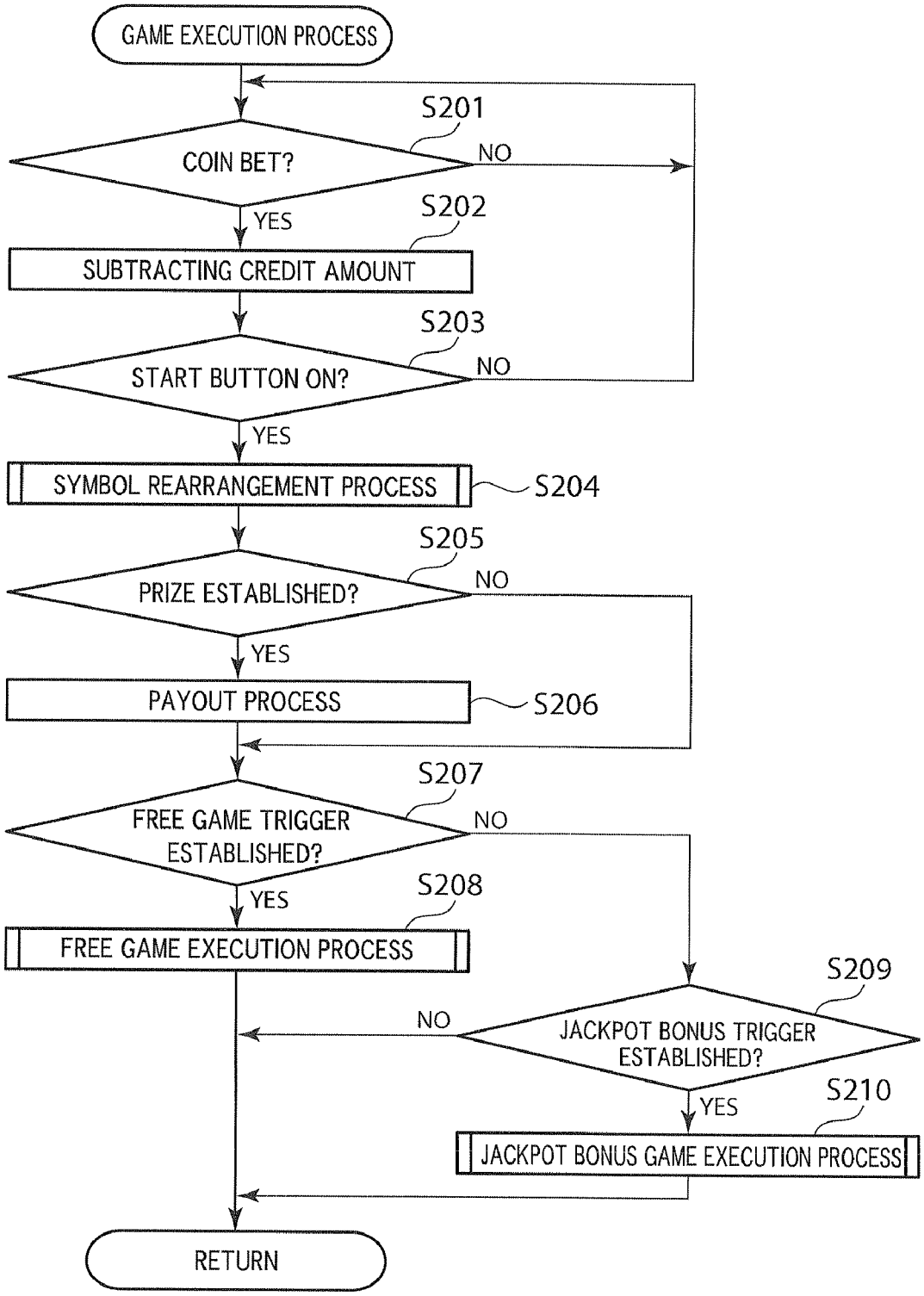
FIG. 12 is a flowchart showing a subroutine of game execution processing.

FIG. 12 is a flowchart showing a subroutine of the game execution process invoked and performed at step S102 of the subroutine shown in FIG. 11. First, the main CPU 41 judges whether a coin has been bet or not (step S201). Specifically, the main CPU 41 judges whether or not an input signal has been received, the signal being output from the 1-BET switch 26S when the 1-BET button 26 is pressed, or alternatively, being output from the MAX-BET switch 27S when the MAX-BET button 27 is pressed. The main CPU 41 controls the current step to return to the process at step S201 upon judging that no coin has been bet (step S201: NO).

On the other hand, the main CPU 41 subtracts the number of bet coins from the credit amount stored in the RAM 43 (step S202) upon judging that a coin has been bet (step S201: YES). In a case where the number of bet coins is greater than the credit amount stored in the RAM 43, the main CPU 41 controls the current step to return to step S201 without performing the process for subtracting the number of bet coins from the credit amount stored in the RAM 43. In a case where the number of bet coins exceeds the upper limit (fifty coins in this embodiment) of coins that can be bet in one game, the main CPU 41 controls the process to shift to step S203 without performing the process for subtracting the number of bet coins from the credit amount stored in the RAM 43.

At step S203, the main CPU 41 judges whether or not the start button 23 has been set to ON (step S203). Specifically, the main CPU 41 judges whether or not an input signal has been received, the signal being output from the start switch 23S when the start button 23 is pushed. The main CPU 41 controls the step to return to step S201 upon judging that the start button 23 has not been set to ON (step S203: NO). Where the start button 23 has not been set to ON (for example, where an instruction has been input to terminate the game without setting the start button 23 to ON), the main CPU 41 cancels acceptance of a subtraction result at step S202.

On the other hand, when the main CPU 41 judges that the start button 23 has been set to ON (step S203: YES), the main CPU 41 carries out symbol rearrangement process which will be described later with reference to FIG. 13 (step S204). Specifically, the CPU 41 executes the program stored in the RAM 43 and determines the symbols to be rearranged in the symbol matrix display region 28 displayed on the lower image display panel 16. The symbols are determined from among the symbols, "WILD" 121, "7" 122, "3 Bar" 123, "2 Bar" 124, "1Bar" 125, and "Blank" 126. This determination is based on the symbol weighting data and random numeric values sampled by sampling the random numeric values in a numerical range which comes under a predetermined range of random numeric values. The CPU 41 then rearranges the symbols in the symbol matrix display region 28.

Next, the main CPU 41 judges whether a prize has been established or not (step S205). Specifically, the main CPU 41 judges whether or not the number of symbols of respective types rearranged in the symbol matrix display region 28 is a winning number allowed to award any of payouts. Here, the prize is established when symbols displayed in the symbol display region 28 are arranged in a predetermined combination on a winning line.

Upon judging that the prize is established (step S205: YES), the main CPU 41 then executes a coin-payout process in accordance with the amount of bet and the number of coins set for the winning number (step S206). Where the coins are deposited, the main CPU 41 executes a process for adding the number of paid-out coins to the credit amount stored in the RAM 43. On the other hand, upon execution of the coin-payout process, the main CPU 41 transmits a control signal to the hopper 66 to pay out the predetermined amount of coins.

On the other hand, the main CPU 41 judges whether a free game trigger has been established or not (step S207) when judging that the prize is not established (step S205: NO) or executing the process at step S206. Specifically, the main CPU 41 executes the program stored in the RAM 43 to sample the random numeric values in a numerical range which comes under a predetermined range of random numeric values, thereby judging whether or not the free game trigger condition has been satisfied based on the sampled random numeric values. The main CPU 41 performs the free game execution process (step S208) when judging that the free game trigger has been established (step S207: YES). In this free-game execution process, the main CPU 41 sequentially reads and executes the game programs or the like from the ROM 42 and performs the free-game execution process.

On the other hand, upon judging that the free game trigger has not been established (step S207: NO), the main CPU 41 judges whether or not a jackpot bonus game trigger has been established (step S209). Specifically, the main CPU 41 executes the program stored in the RAM 43 to sample the random numeric values in a numerical range which comes under a predetermined range of random numeric values, thereby judging whether or not the jackpot bonus game trigger has been established based on the sampled random numeric values. Upon judging the jackpot bonus game trigger has been established (step S209), the main CPU 41 carries out the jackpot bonus game execution process (step S210). In this jackpot bonus game, the main CPU 41 sequentially reads and executes the game programs or the like from the ROM 42 to execute the jackpot bonus execution process.

The CPU 41 terminates the game execution process when judging that the jackpot bonus game trigger has not been established (step S209: NO) or when executing the process at step S208 or S210.

Figure 13:
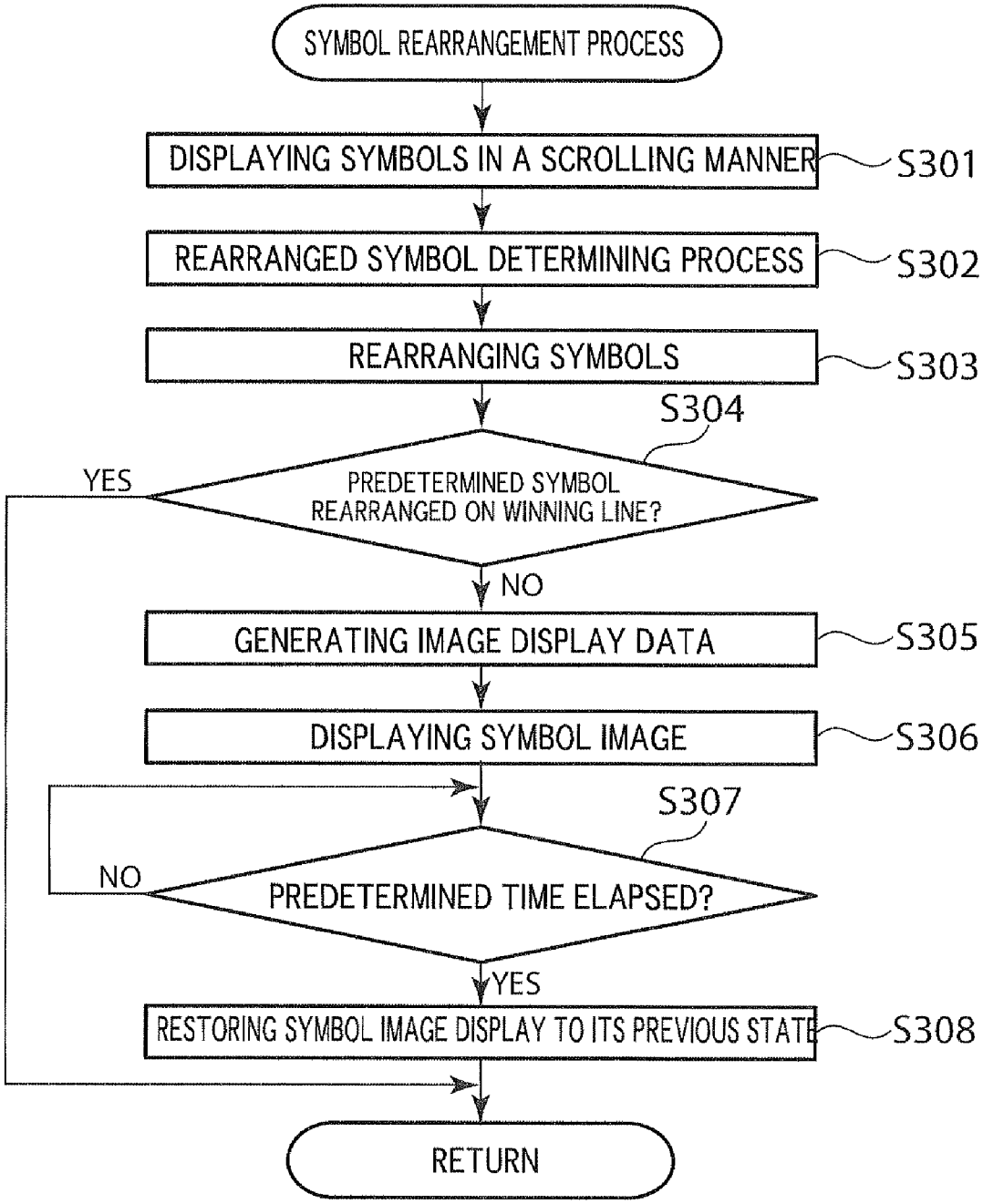
FIG. 13 is a flowchart showing a subroutine of symbol rearrangement process according to the first embodiment.

FIG. 13 is a flowchart showing a subroutine of the symbol rearrangement process invoked and performed at step S204 of the subroutine shown in FIG. 12. First, the main CPU 41 displays the symbols in a scrolling manner (step S301). Specifically, the main CPU 41 starts rotation of the reels 102*a* to 102*c*. In this case, the six basic lines BL are set in the column and row directions, in the symbol matrix display region 28. Further, the two cross lines CL are set in directions that obliquely cross the symbol matrix display region 28.

Next, the main CPU 41 determines the symbols to be rearranged (step S302). Specifically, the CPU 41 executes the program stored in the RAM 43 and determines the symbols to be rearranged in the symbol matrix display region 28 displayed on the lower image display panel 16. The symbols are determined from among the symbols, "WILD" 121, "7" 122, "3 Bar" 123, "2 Bar" 124, "1Bar" 125, and "Blank" 126. This determination is based on the symbol weighting data and random numeric values sampled by sampling the random numeric values in a numerical range which comes under a predetermined range of random numeric values.

The main CPU 41 then rearranges the symbols (step S303). Specifically, the main CPU 41 stops rotation of the reels 102*a* to 102*c* so as to display, in a stopped state, the symbols determined at step S302, thereby rearranging the symbols.

Next, the main CPU 41 judges whether or not a combination is a predetermined one (step S304). Specifically, the main CPU 41 judges whether or not the symbols displayed in the symbol matrix display region 28 are arranged in a predetermined combination allowed to award any of payouts. The main CPU 41 terminates the symbol rearrangement process when judging that a combination is a predetermined one (step S304: YES).

On the other hand, upon judging that arrangement of one of the symbols displayed in the symbol matrix display region 28 does not form a predetermined combination on a winning line (step S304: NO), the main CPU 41 reads out of the ROM 42, the reel data and the symbol image data corresponding to the symbols having not been arranged in the symbol matrix display region 28, from among the symbols set in array on the reel 102*c*. Based on the symbol image data and the reel data read out of the ROM 42, the main CPU 41 generates image display data that the images of symbols which have not been arranged in the symbol matrix display region 28 from among symbols arranged in array on the reel 102*c*, are filled in the reel image in the reel shape (step S305). Based on the generated image display data, the main CPU 41 displays in the symbol matrix display region 90, the reel image that the symbol images are filled in the reel image in the reel shape in a manner to correspond to display on the symbol matrix display region 28 (step S306).

After a predetermined period has elapsed (step S307: YES), the main CPU 41 then restores display on the symbol image display region 90 to its previous state (step S308), and terminates this process. In the foregoing description, the main CPU 41 generates image display data during a period from stop of rotation of the reels 102*a* to 102*c* to acceptance of input of operation from the BET button or the SPIN button serving as the input device. Based on this image display data, the main CPU 41 displays in the symbol image display region 90, the reel image that symbol images are filled in the reel image in the reel shape. This dispels confusions on display as to whether the prize is awarded or not. While the foregoing embodiment described the case where the reel image corresponding to the reel 102*c* is displayed, this embodiment can be applied to the reels 102*a*, 102*b* in a similar manner.

Figure 14A:
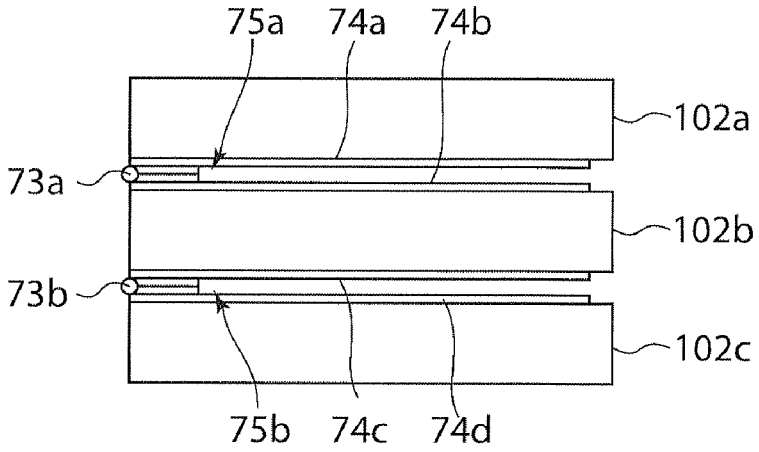
FIG. 14A is an illustrative view depicting a reel part of the slot machine according to a second embodiment of the present invention, in a state before the reel part is pivotally moved.
Figure 14B:
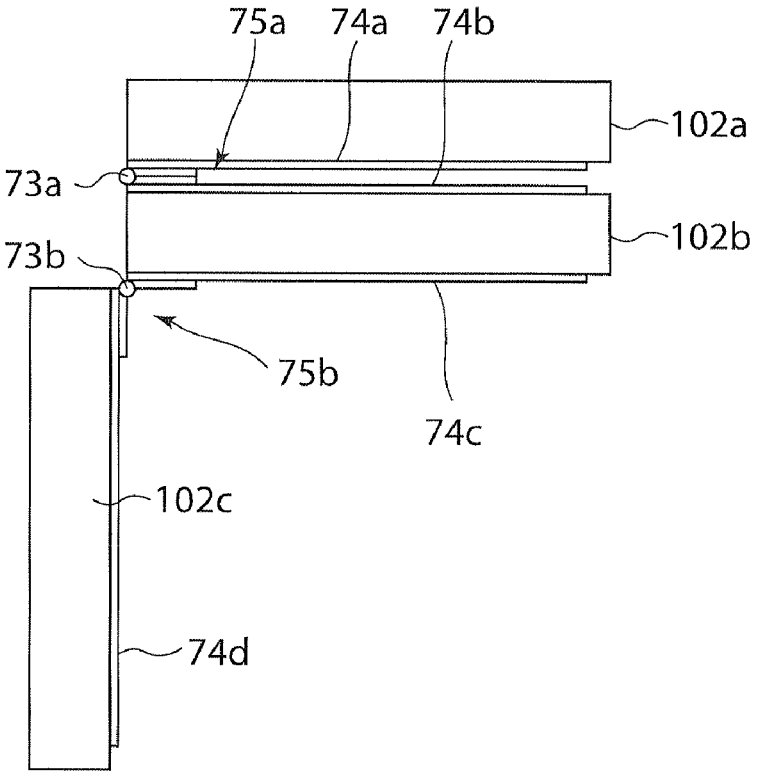
FIG. 14B is an illustrative view depicting the reel part of the slot machine according to the second embodiment of the present invention, in a state after the reel part is pivotally moved.
Figure 15A:
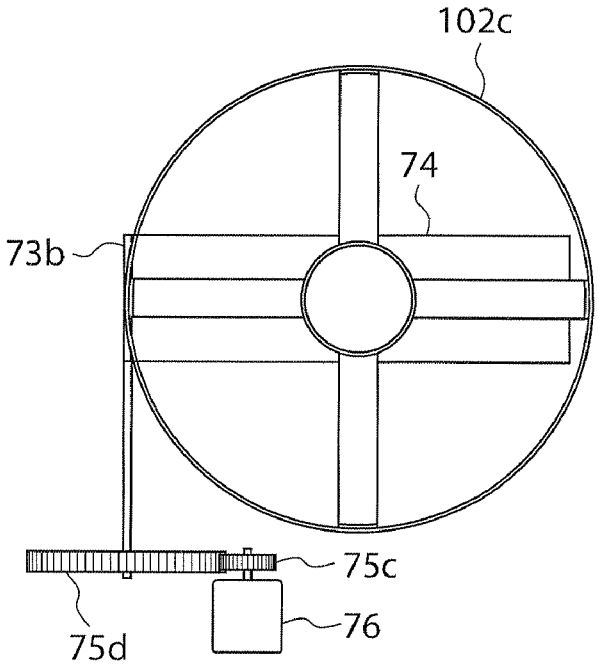
FIG. 15A is an illustrative view depicting a driving mechanism in a state before the reel part of the slot machine according to the second embodiment of the present invention is pivotally moved.
Figure 15B:
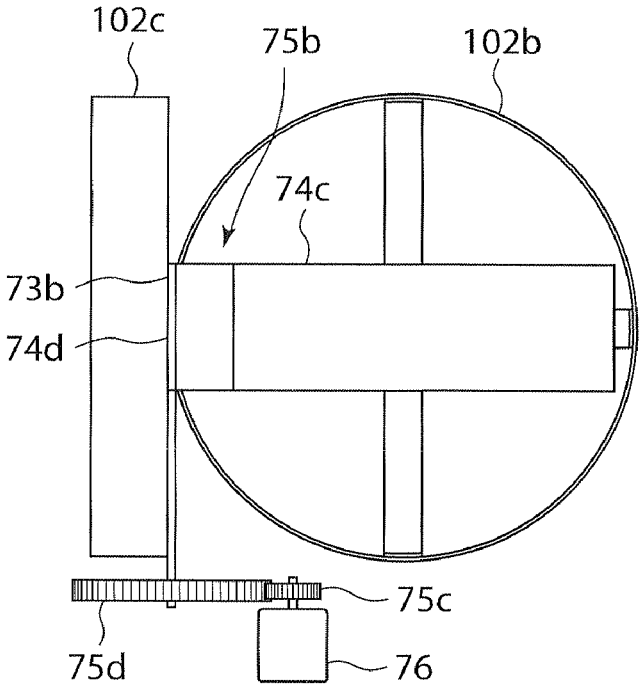
FIG. 15B is an illustrative view depicting a driving mechanism in a state after the reel part according to the second embodiment of the present invention is pivotally moved.

FIGS. 14A and 14B are illustrative views each depicting a reel part of the slot machine according to a second embodiment of the present invention. FIGS. 15A and 15B are illustrative views each depicting a driving mechanism of the reel part of the slot machine according to the second embodiment of the present invention. At a left side of the reels 102*a* to 102*c* in FIGS. 14A and 14B, the aforementioned lower image display panel 16 is disposed.

A joint 75*a* includes board 74*a*, 74*b*, and a hinge 73*a*. The board 74*a* is not rotated with the reel 102*a*. The board 74*b* is not rotated with the reel 102*b*. The hinge 73*a* couples the boards 74*a*, 74*b* to each other. The joint 75*a* is configured so as to pivotally move the reel 102*a* in a direction of an upper side of FIG. 14A. A joint 75*b* includes a board 74*c*, a board 74*d*, and a hinge 73*b*. The board 74*c* is not rotated with the reel 102*b*. The board 74*d* is not rotated with the reel 102*c*. The hinge 73*b* couples the boards 74*c*, 74*d* to each other. As shown in FIG. 14B, the joint 75*b* is configured so as to pivotally move the reel 102*c* in a direction of a lower direction of FIG. 14B. As shown in FIGS. 15A and 15B, the driving device 76 for driving the reels is made up of a motor, for example. The driving device 76 can render the reel 102*c* enter a pivotally unmoved state as shown in FIG. 15A and a pivotally moved state as shown in FIG. 15B, for example, with driving power of the motor transmitting through a gear 75*c* and large-size gear 75*d* to the hinge 73*b*. In this state, the symbols set in array on the reel 102*c* can be visually confirmed by rendering transparent, the transparent region of the lower display panel 16 disposed at a front surface of the reel 102*c*.

Figure 16:
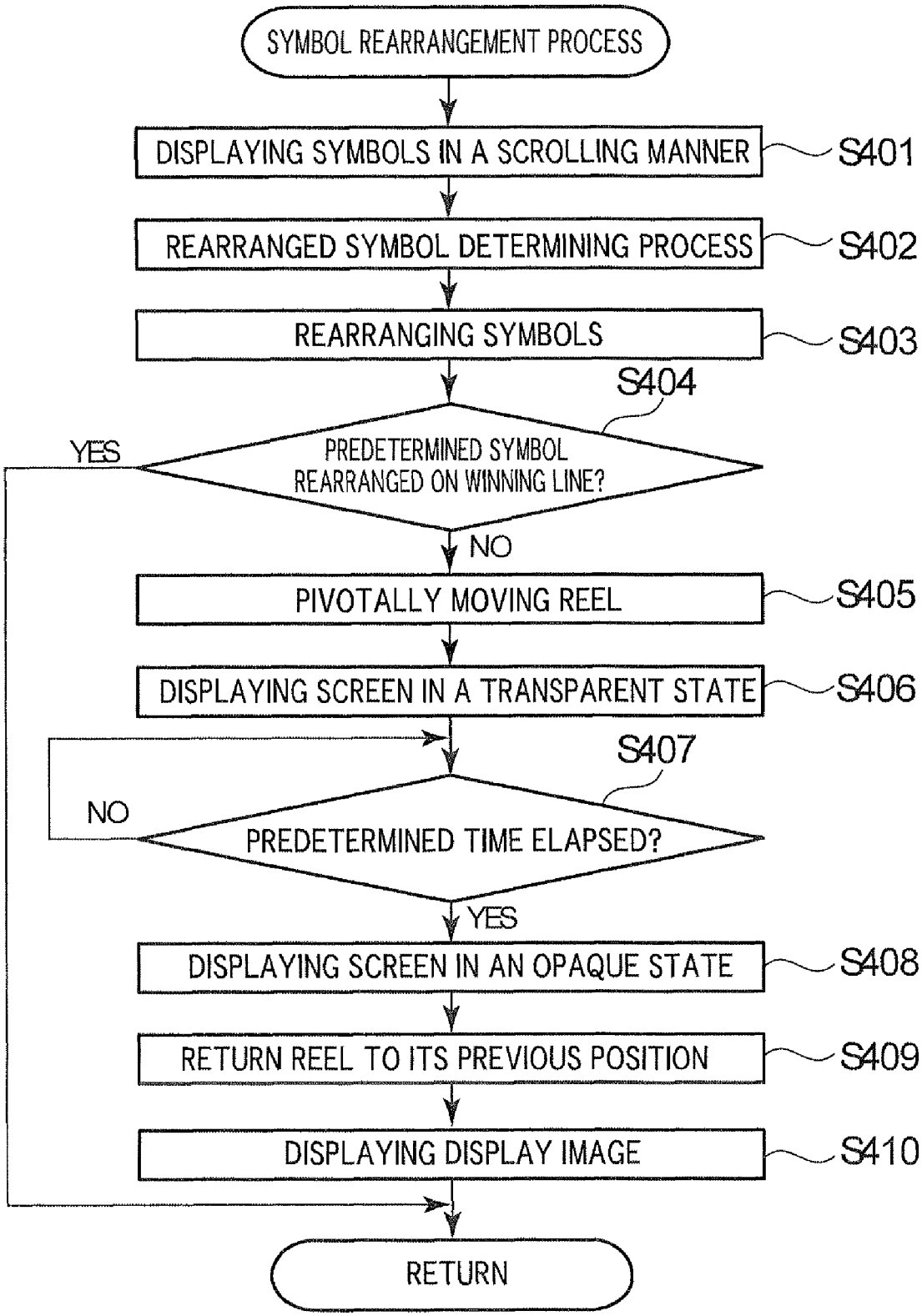
FIG. 16 is an operational flowchart of a symbol rearrangement process of the slot machine according the second embodiment of the present invention.

FIG. 16 is an operational flowchart of a symbol rearrangement process of the slot machine according the second embodiment of the present invention. First, the main CPU 41 displays the symbols in a scrolling manner during the basic game (step S401). Specifically, the main CPU 41 starts rotation of the plurality of reels 102*a* to 102*c*. In this case, the six basic lines BL are set in the column and row directions, respectively, in the symbol matrix display region 28. Further, the two cross lines CL are set in directions that obliquely cross the symbol matrix display region 28.

Next, the main CPU 41 determines the symbols to be rearranged (step S402). Specifically, the main CPU 41 executes the program stored in the RAM 43 and determines the symbols to be rearranged in the symbol matrix display region 28. The symbols are determined from among the symbols, "WILD" 121, "7" 122, "3 Bar" 123, "2 Bar" 124, "1Bar" 125, and "Blank" 126. This determination is based on the symbol weighting data and random numeric values sampled by sampling the random numeric values in a numerical range which comes under a predetermined range of random numeric values.

The main CPU 41 then rearranges the symbols (step S403). Specifically, the main CPU 41 stops rotation of the reels 102*a* to 102*c* so as to display, in a stopped manner, the symbols determined at step S402, thereby rearranging the plural types of symbols in the symbol matrix display region 28.

Next, the main CPU 41 judges whether or not the symbols displayed in the symbol matrix display region 28 are arranged in the predetermined combination on the winning line (step S404). Specifically, the main CPU 41 judges whether or not the symbols displayed in the symbol matrix display region 28 are arranged in the predetermined combination allowed to award any of payouts. The main CPU 41 terminates the symbol rearrangement process when judging that the combination is a predetermined one (step S404: YES).

On the other hand, upon judging that the combination is not a predetermined one (step S404: NO), the main CPU 41 controls the driving device 76 to pivotally move the reel 102*c* to a position where the symbols other than the symbols arranged in the symbol matrix display region 28 can be visually confirmed. Specifically, the main CPU 41 controls the driving device 76 to pivotally move the reel 102*c* to a side of the lower image display panel by driving the hinge 73*b* with the driving power of the motor, as shown in FIG. 15B (step S405). The main CPU 41 exercises control to render the transparent region outside the symbol matrix display region 28 transparent so as to make visually confirmable the symbols set in array on the reel 102*c* having been pivotally moved (step S406). In this state, the player can visually confirm the images of the symbols set in array on the reel 102*c*.

After the predetermined period has elapsed (step S407: YES), the main CPU 41 then exercises control to render display on the transparent region of the lower image display panel 16 be in an opaque state (step S408). Next, the main CPU 41 controls the driving device 76 to execute a process for returning the reel 102*c* to its previous position by rotating the hinge 73 in the opposite direction with the driving power of the motor, as shown in FIG. 15A (step S409). The main CPU 41 then displays the display image in the symbol image display region 90 (step S410), and terminates this process. The main CPU 41 pivotally moves the reel 102*c* during a period from stop of the reels 102*a* to 102*c* to acceptance of operation input from the BET button or the SPIN button serving as the input device, thereby exercising control to render the transparent region transparent. This dispels confusions on display as to whether the prize is awarded or not.

Figure 17A:
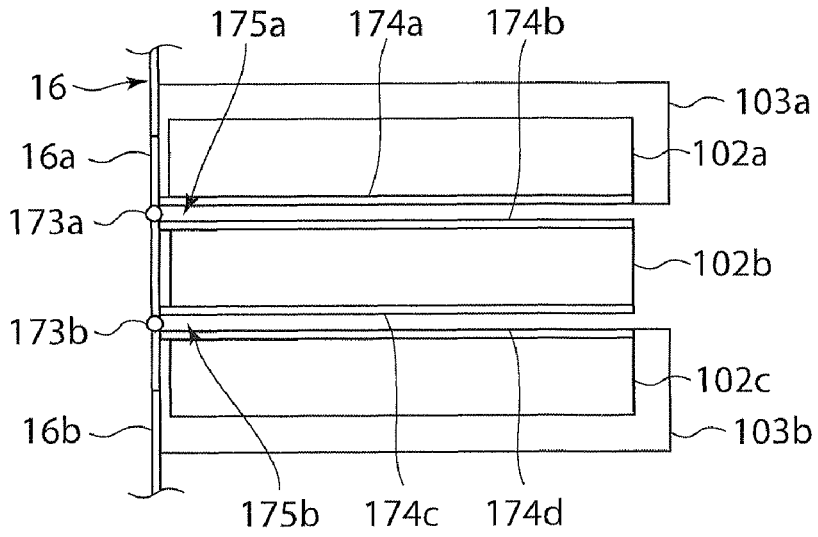
FIG. 17A is an illustrative view depicting a display part of the slot machine according to a third embodiment of the present invention, in a state before the display part is pivotally moved.
Figure 17B:
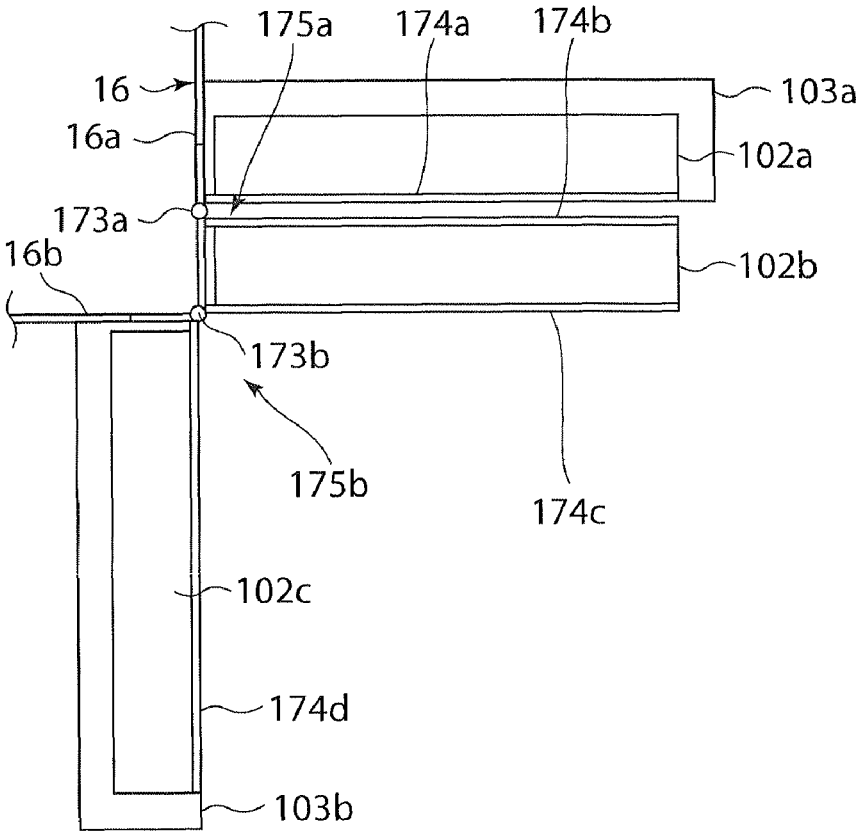
FIG. 17B is an illustrative view depicting the display part of the slot machine according to the third embodiment of the present invention, in a state after the display part is pivotally moved.

FIGS. 17A and 17B are views depicting a configuration in a case where the display part in the slot machine according to a third embodiment of the present invention is pivotally moved. The lower image display panel 16 has folding regions 16*a*, 16*b* part of which corresponding to at least one part of the plural reels 102*a* to 102*c* can be folded. The joint 175*a* includes boards 174*a*, 174*b*, and a hinge 173*a*. The board 174*a* is not rotated with the reel 102*a*. The board 174*b* is not rotated with the reel 102*b*. The hinge 173*a* couples the boards 174*a*, 174*b* to each other. The joint 175*a* is provided to couple the reel 102*a* to the folding region 16*a* of the lower image display panel 16. The joint 175*b* includes boards 174*c*, 174*d*, and a hinge 173*b*. The board 174*c* is not rotated with the reel 102*b*. The board 174*d* is not rotated with the reel 102*c*. The hinge 173*b* couples the boards 174*c*, 174*d* to each other. The joint 175*a* is provided to couple the reel 102*c* to the folding region 16*b* of the lower image display panel 16. The reels 102*a*, 102*c* are contained in transparent containers 103*a*, 103*b*, respectively, so as not to be exposed to an outside when the folding region is pivotally moved.

The driving device 77 shown in FIG. 4 is made up of a motor, for example. This driving device 77 is coupled to the hinges 173*a*, 173*b* via a gear not shown, in a manner similar to that shown in FIGS. 15A and 15B. By driving of the driving device 77, as shown in FIG. 17B, the folding region 16*b* of the lower image display panel 16 can be pivotally moved with the reel 102 to the position where symbols can be visually confirmed, the symbols being other than the symbols arranged in the symbol matrix display region 28 from among the symbols set in array on the reel 102*c*.

Figure 18:
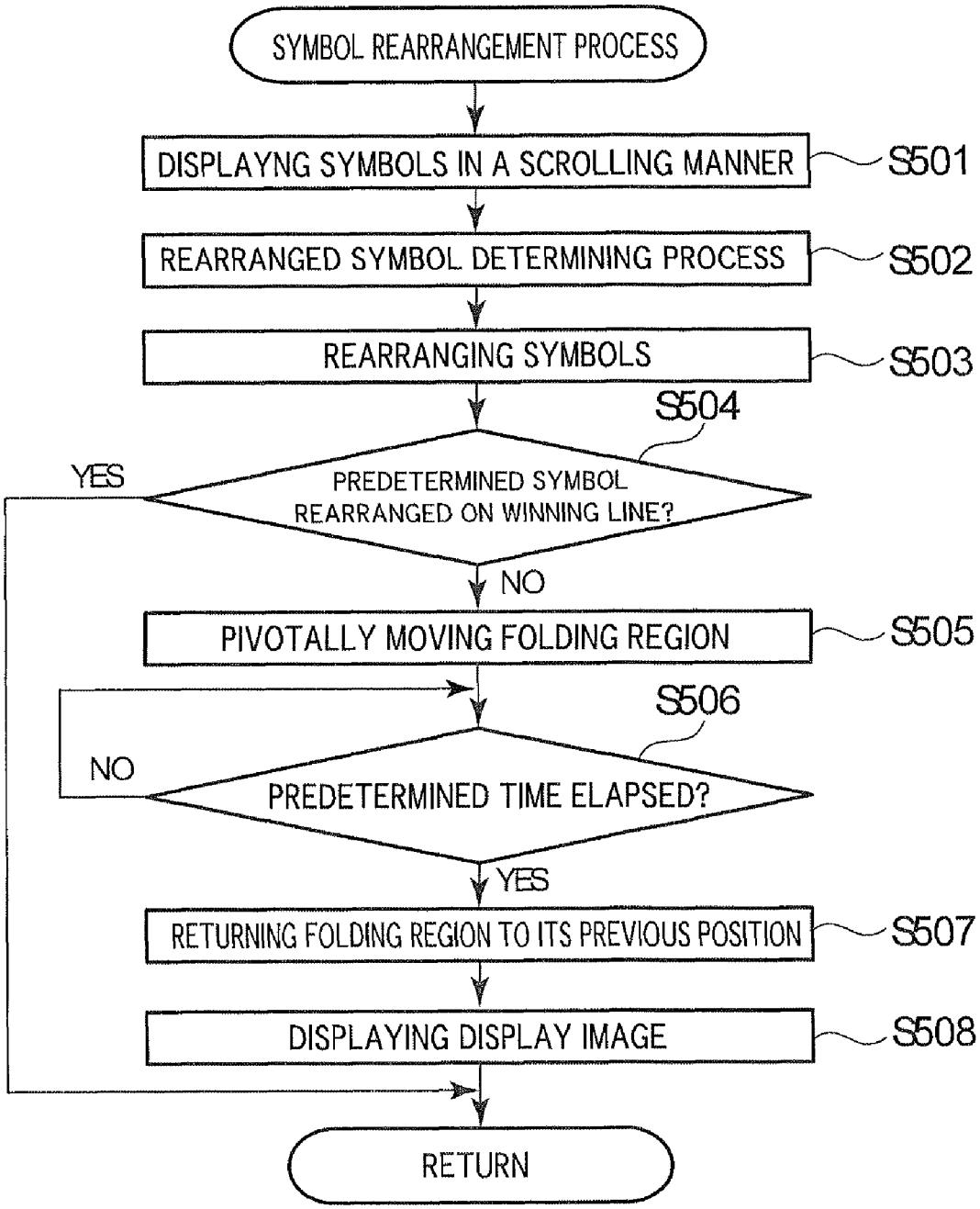
FIG. 18 is an operational flowchart in a case where the display part of the slot machine according to the third embodiment of the present invention is pivotally moved.

FIG. 18 is an operational flowchart in a case where the display part of the slot machine according to the third embodiment of the present invention is pivotally moved. First, the main CPU 41 displays the symbols in a scrolling manner during the basic game (step S501). Specifically, the main CPU 41 starts rotation of the plurality of reels 102*a* to 102*c*. In this case, the six basic lines BL are set in the column and row directions in the symbol matrix display region 28. Further, the two cross lines CL are set in directions that obliquely cross the symbol matrix display region 28.

Next, the main CPU 41 determines the symbols to be rearranged (step S502). Specifically, the CPU 41 executes the program stored in the RAM 43 and determines the symbols to be rearranged in the symbol matrix display region 28. The symbols are determined from among the symbols, "WILD" 121, "7" 122, "3 Bar" 123, "2 Bar" 124, "1Bar" 125, and "Blank" 126. This determination is based on the symbol weighting data and random numeric values sampled by sampling the random numeric values in a numerical range which comes under a predetermined range of random numeric values.

The main CPU 41 then rearranges the symbols (step S503). Specifically, the main CPU 41 stops rotation of the reels 102*a* to 102*c* so as to display, in a stopped manner, the symbols determined at step S502, thereby rearranging the plural types of symbols in the symbol matrix display region 28.

Next, the main CPU 41 judges whether or not the symbols displayed in the symbol matrix display region 28 are arranged in the predetermined combination on the winning line (step S504). Specifically, the main CPU 41 judges whether or not the symbols displayed in the symbol matrix display region 28 are arranged in the predetermined combination allowed to award any of payouts. The main CPU 41 terminates the symbol rearrangement process when judging that the combination is a predetermined one (step S504: YES). The main CPU 41 then awards a payout corresponding to a winning combination.

On the other hand, upon judging that the combination is not a predetermined one (step S504: NO), the main CPU 41 controls the driving device 77 so as to pivotally move the folding region 16*b* to the position where the symbols other than the symbols arranged in the symbol matrix display region 28 can be visually confirmed (step S505). Specifically, the main CPU 41 controls the driving device 77 to drive the hinge 173*b* with the driving power of the motor so as to pivotally move the folding region of the lower image display panel 16 with the reel 102*c*. In this state, the player can visually confirm the images of the symbols set in array on the reel 102*c*.

After the predetermined period has elapsed (step S506: YES), the main CPU 41 controls the driving device 77 to drive the hinge 173*b* with the driving power of the motor, as shown in FIG. 17A, so as to return the folding region 16*b* of the lower image display panel 16 to its previous position (step S507). The main CPU 41 then displays the display image in the symbol image display region 90 (step S508), and terminates the process.

Figure 19:
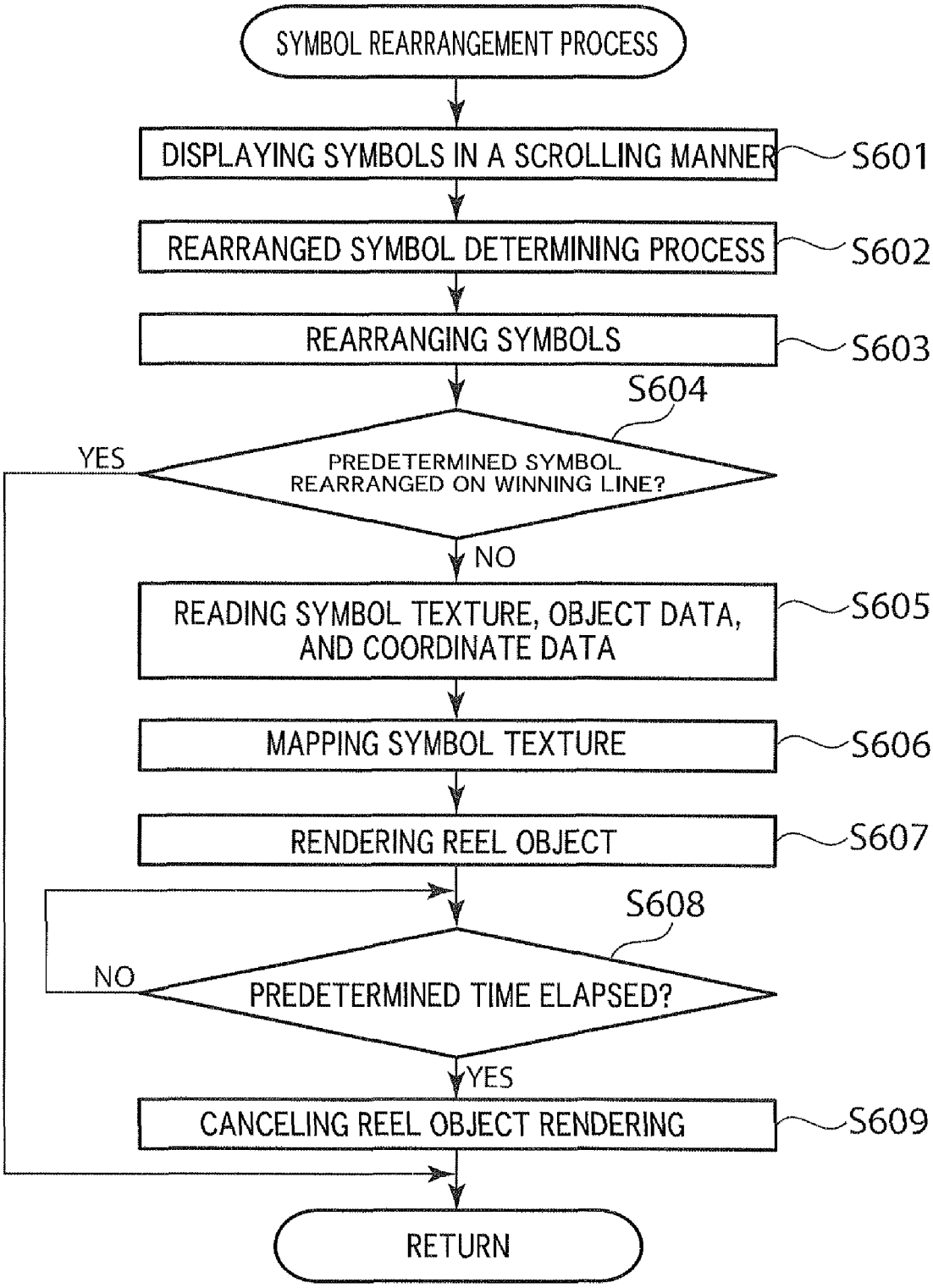
FIG. 19 is a flowchart showing a subroutine of a symbol rear-arrangement process according to a fourth embodiment of the present invention.

FIG. 19 is an operational flowchart of the symbol rearrangement process of a slot machine according to a fourth embodiment of the present invention. First, the main CPU 41 displays the symbols in a scrolling manner during the basic game (step S601). Specifically, the main CPU 41 starts rotation of the plurality of reels 102*a* to 102*c*. In this case, the six basic lines BL are set in the column and row directions in the symbol matrix display region 28. Further, the two cross lines CL are set in directions that obliquely cross the symbol matrix display region 28.

The main CPU 41 then determines the symbols to be rearranged (step S602). Specifically, the CPU 41 executes the program stored in the RAM 43 and determines the symbols to be rearranged in the symbol matrix display region 28. The symbols are determined from among the symbols, "WILD" 121, "7" 122, "3 Bar" 123, "2 Bar" 124, "1Bar" 125, and "Blank" 126. This determination is based on the symbol weighting data and random numeric values sampled by sampling the random numeric values in a numerical range which comes under a predetermined range of random numeric values.

The main CPU 41 then rearranges the symbols (step S603). Specifically, the main CPU 41 stops rotation of the reels 102*a* to 102*c* so as to display, in a stopped state, the symbols determined at step S602, thereby rearranging the plurality of symbols in the symbol matrix display region 28.

Next, the main CPU 41 judges whether or not the symbols displayed in the symbol matrix display region 28 are arranged in the predetermined combination on the winning line (step S604). Specifically, the main CPU 41 judges whether or not the symbols displayed in the symbol matrix display region 28 are arranged in the predetermined combination allowed to award any of payouts. The main CPU 41 terminates the symbol rearrangement process when judging that the combination is a predetermined one (step S604: YES).

On the other hand, upon judging that the combination is not a predetermined one (step S604: NO), the main CPU 41 read out the symbol textures, the object data, and the coordinate data (step S605). Specifically, the main CPU 41 reads the symbol textures, the object data, and the symbol array coordinate data out of the ROM 42. The frontside and backside symbol textures are identical or similar to symbols not arranged in the symbol matrix display region 28, from among the symbols set in array on the reel 102*c*. The object data is relating to the reel defined in a virtual three-dimensional space.

The main CPU 41 then maps the symbol textures (step S606). Specifically, based on the data read out at step S605, the main CPU 41 refers to the symbol array coordinate data on the object of the reel defined in the virtual three-dimensional space in the symbol image display region 90 in a manner to correspond to display on the symbol matrix display region 28, based on the data read out at step S605, and then maps the symbol textures of the symbols not arranged in the symbol matrix display region from among the symbols set in array on the reel.

Next, the main CPU 41 renders the object of the reel (step S607). Specifically, the main CPU 41, at step S606, refers to the symbol array coordinate data on the object of the reel defined in the virtual three-dimensional space in the symbol image display region 90 in a manner to correspond to display on the symbol matrix display region 28, and then renders the object of the reel in real time by mapping the symbol textures of the symbol not arranged in the symbol matrix display region 28 from among the symbols set in array on the reel. The symbol array coordinate data is stored in the RAM 42 to set the symbol textures in array on the reel object in a manner similar to the array on the mechanical reel 102. Usage of this symbol array coordinate data enables the symbol textures to be mapped on the reel object in a manner similar to the array of symbols drawn on the reel 102*c*.

Next, the main CPU 41 judges whether or not a predetermined period has elapsed (step S608). Specifically, the main CPU 41 judges at step S 608, whether or not the reel object has been rendered in real time for a predetermined period, the reel object being mapped by the symbol textures of the symbols not arranged in the symbol matrix display region 28 from among the symbols set in array on the reel. Upon judging that a predetermined period has not elapsed (step S608: NO), the main CPU 41 controls the current step to return to the process at step S608.

On the other hand, upon judging that a predetermined period has elapsed (step S608: YES), the main CPU 41 cancels reel object rendering (step S609). Specifically, the main CPU 41 restores display on the symbol image display region 90 to its previous state. The main CPU 41 terminates the symbol rearrangement process when terminating this process. While the foregoing embodiment described the case where the reel image corresponding to the reel 102*c* is displayed, this embodiment can be applied to the reels 102*a*, 102*b* in a similar manner.

Figure 20A:
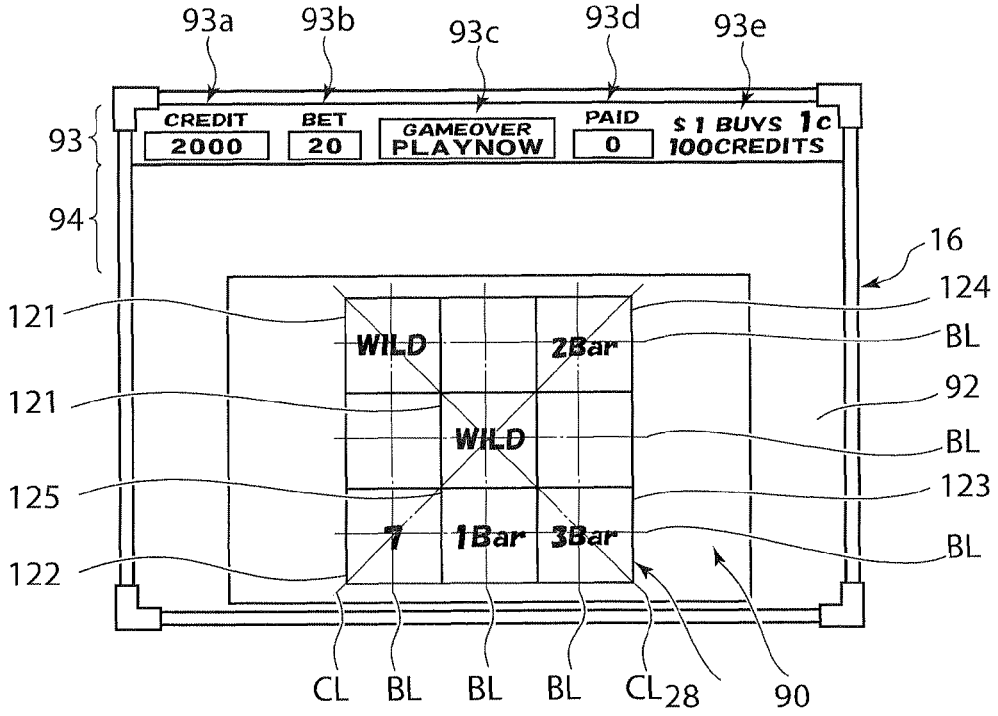
FIG. 20A is a view showing an exemplary image displayed on a lower image display panel of a slot machine according to a fifth embodiment.
Figure 20B:
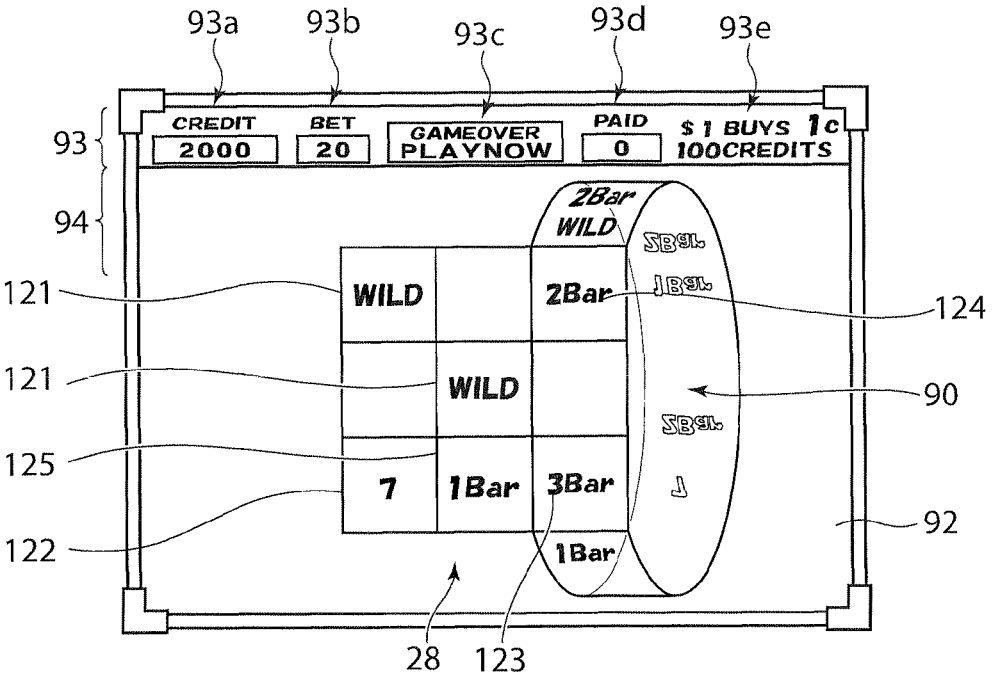
FIG. 20B is a view showing an exemplary image displayed on the lower image display panel of the slot machine according to the fifth embodiment.

FIGS. 20A and 20B are views each showing an exemplary image displayed in the slot machine shown in FIG. 2 according to the fifth embodiment. As shown in FIG. 20A, any combination of symbols "WILD" 121, "7" 122, "3Bar" 123, "2Bar" 124, "1Bar" 125, and "Blank" 126 is rearranged in the symbol matrix display region 28. In a case where a combination of symbols arranged in the symbol matrix display region 28 is not a predetermined one on a winning line, from among the symbols set in array on the reel 102*c*, images of symbols not arranged in the symbol display region 28 are displayed by filling them in the reel image in the reel shape, as shown in FIG. 20B. FIG. 20B is different from FIG. 1 in that the reel 102*a* to 102*c* are displayed in the symbol matrix display region 28 and the aforementioned reel image is displayed in a symbol image display region 90 in a manner to correspond to the reel 102*c*.

Figure 21A:
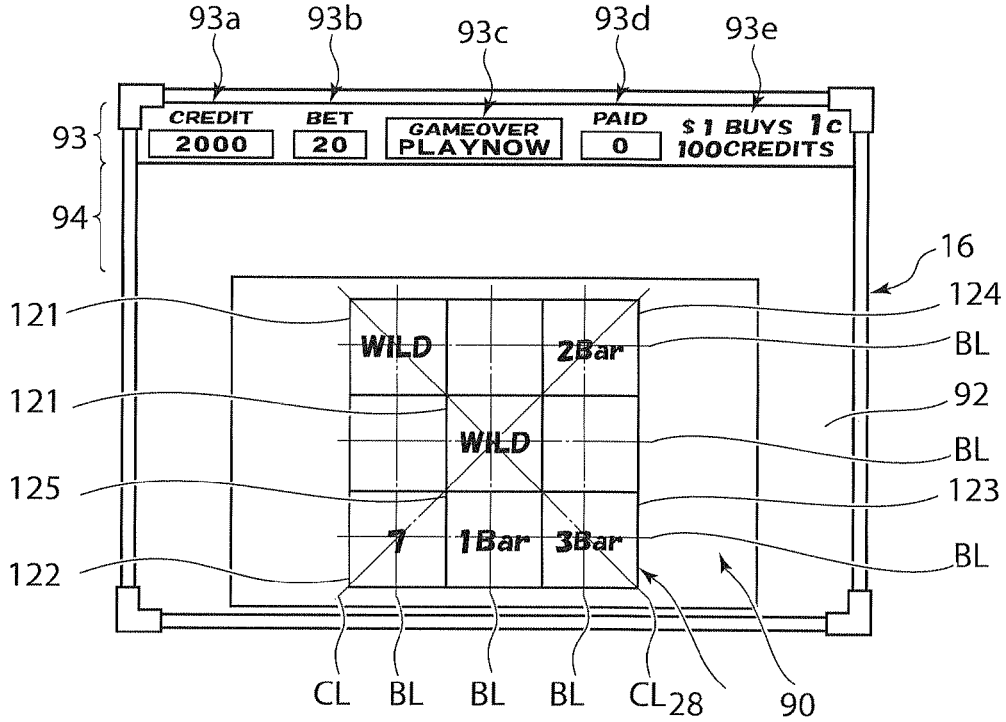
FIG. 21A is a view showing an exemplary image displayed on the lower image display panel of the slot machine according to the fifth embodiment.
Figure 21B:
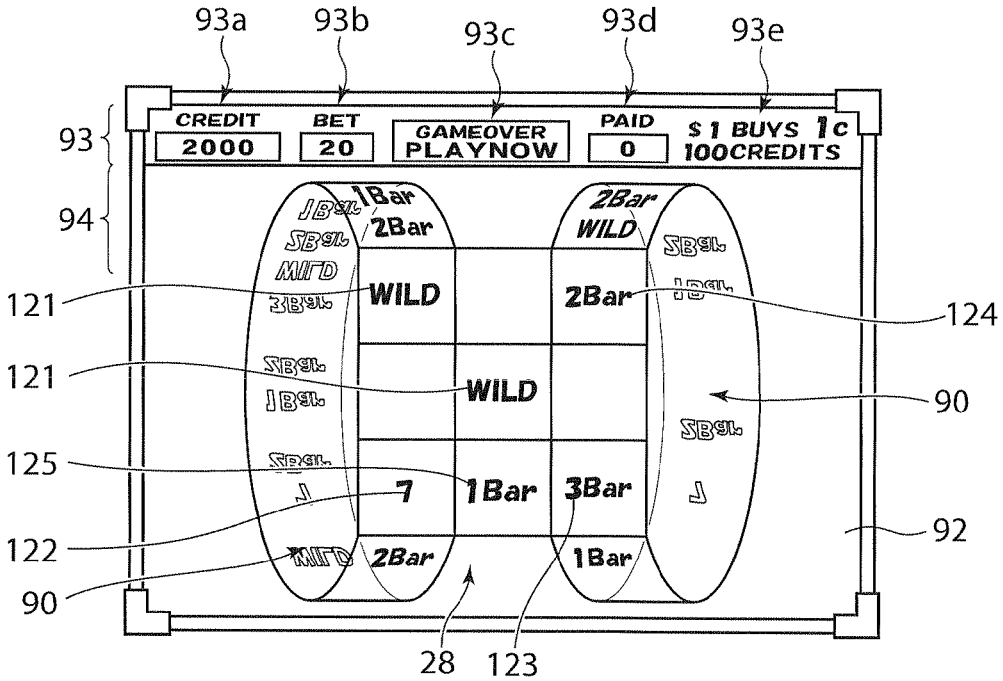
FIG. 21B is a view showing an exemplary image displayed on the lower image display panel of the slot machine according to the fifth embodiment.

FIGS. 21A and 21B are views each showing an exemplary image displayed in the slot machine shown in FIG. 2 according to the first embodiment. As shown in FIG. 21A, any combination of symbols "WILD" 121, "7" 122, "3Bar" 123, "2Bar" 124, "1Bar" 125, and "Blank" 126 is rearranged in the symbol matrix display region 28. In a case where a combination of symbols arranged in the symbol matrix display region 28 is not a predetermined one on a winning line, from among the symbols set in array on the reels 102*a* and 102*c*, images of symbols not arranged in the symbol display region 28 are displayed by filling them in the reel images in the reel shape, as shown in FIG. 21B. FIG. 20B is different from FIG. 1 in that the aforementioned reel image is displayed in a manner to correspond to the reels 102*a*, 102*c*.

Figure 22A:
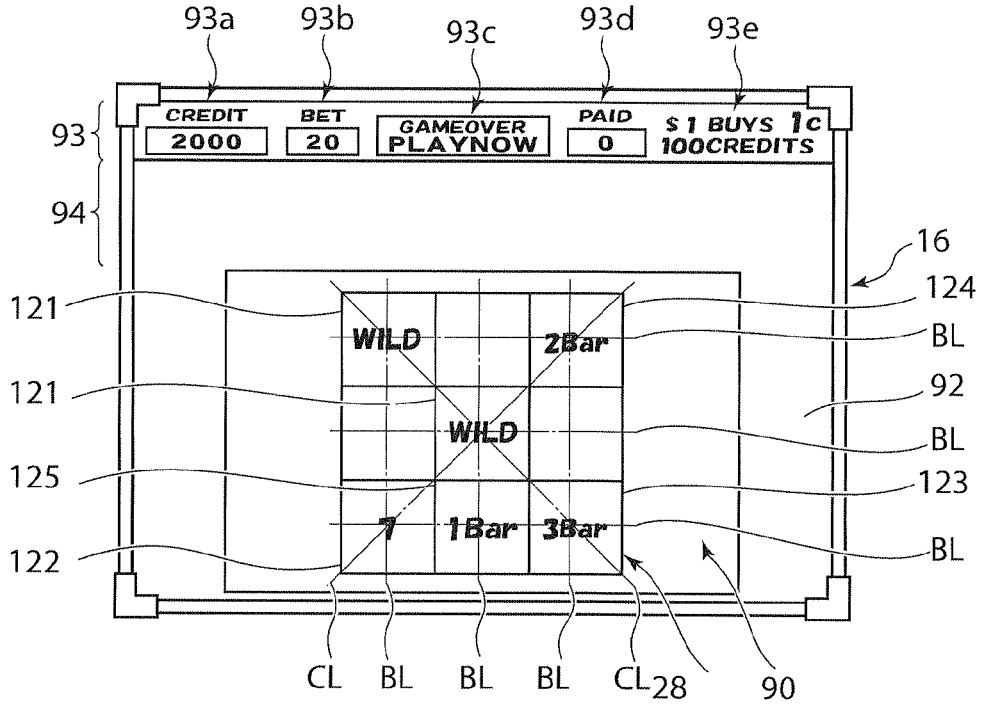
FIG. 22A is a view showing an exemplary image displayed on the lower image display panel of the slot machine according to the fifth embodiment.
Figure 22B:
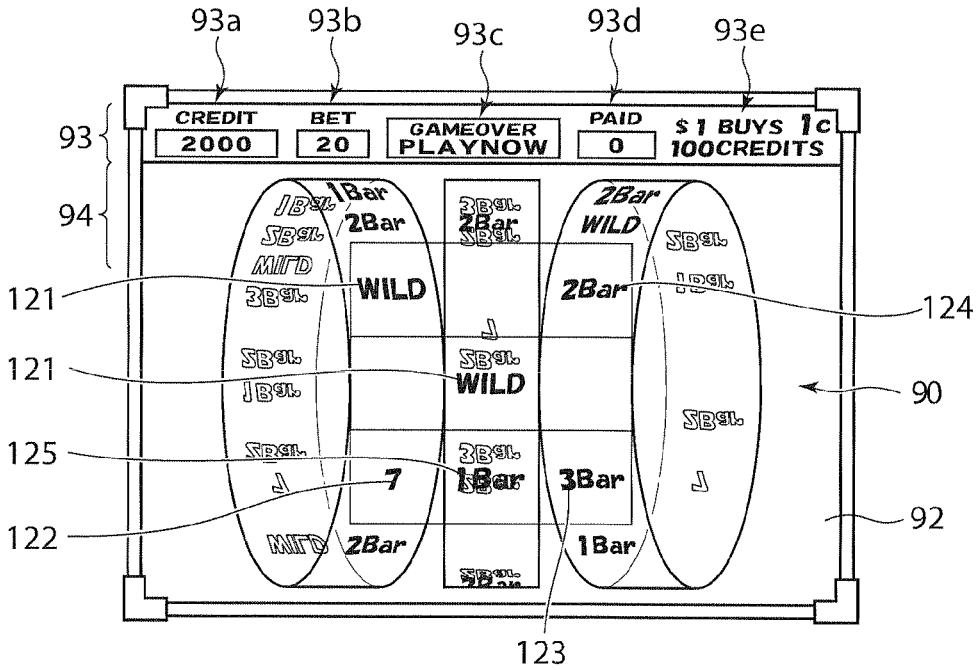
FIG. 22B is a view showing an exemplary image displayed on the lower image display panel of the slot machine according to the fifth embodiment.

FIGS. 22A and 22B are views each showing an exemplary image displayed in the slot machine shown in FIG. 2 according to the fifth embodiment. As shown in FIG. 22A, any combination of symbols "WILD" 121, "7" 122, "3Bar" 123, "2Bar" 124, "1Bar" 125, and "Blank" 126 is rearranged in the symbol matrix display region 28. In a case where a combination of symbols arranged in the symbol matrix display region 28 is not a predetermined one on a winning line, images of the symbols set in array on the reels 102*a* to 102*c* are displayed by filling them in the reel image in the reel shape, as shown in FIG. 22B. In FIG. 22B, the symbols set in array on the reels 102*a* to 102*c* displayed in the symbol matrix display region 28 are made opaque. FIG. 22B is different from FIG. 1 in that the aforementioned reel image is displayed in a manner to correspond to all of the reels 102*a* to 102*c*.

Figure 23A:
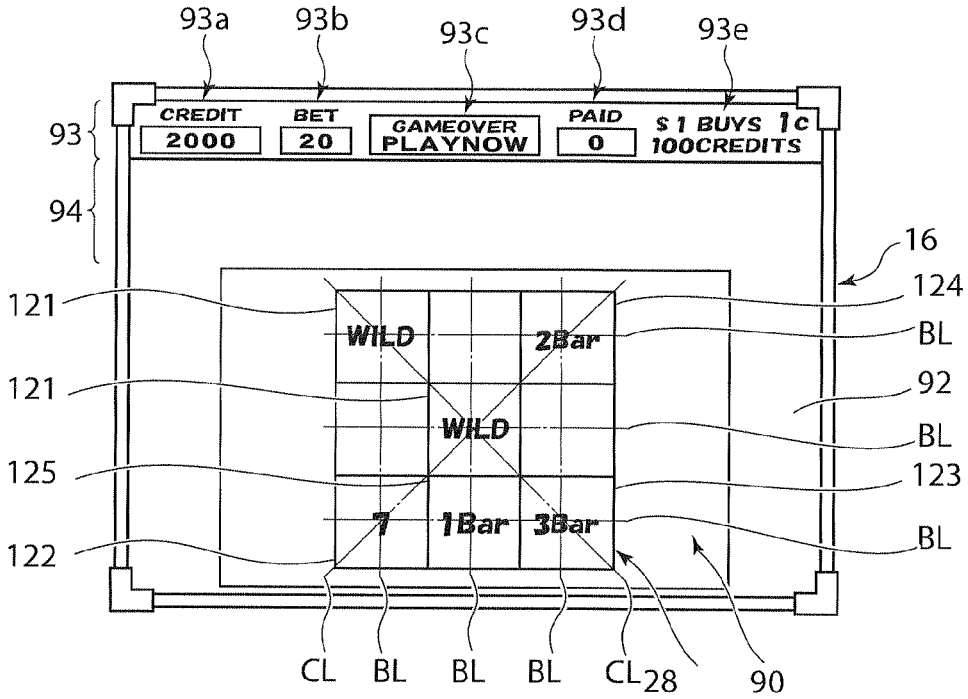
FIG. 23A is a view showing an exemplary image displayed on the lower image display panel of the slot machine according to the fifth embodiment.
Figure 23B:
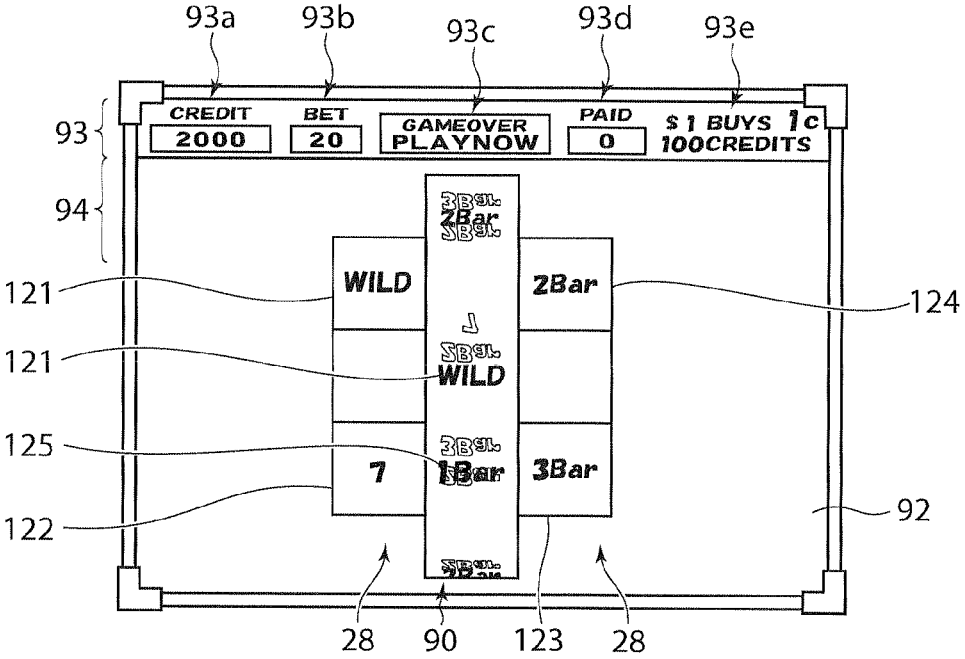
FIG. 23B is a view showing an exemplary image displayed on the lower image display panel of the slot machine according to the fifth embodiment.

FIGS. 23A and 23B are views each showing an exemplary image displayed in the slot machine shown in FIG. 2 according to the fifth embodiment. As shown in FIG. 23A, any combination of symbols "WILD" 121, "7" 122, "3Bar" 123, "2Bar" 124, "1Bar" 125, and "Blank" 126 is rearranged in the symbol matrix display region 28. In a case where a combination of symbols arranged in the symbol matrix display region 28 is not a predetermined one on a winning line, from among the symbols set in array on the reel 102*c*, images of symbols not arranged in the symbol display region 28 are displayed by filling them in the reel image in the reel shape, as shown in FIG. 23B. In FIG. 23B, the symbols set in array on the reel

102*a* displayed in the symbol matrix display region 28 are made opaque. FIG. 23B is different from FIG. 1 in that the aforementioned reel image is displayed in a manner to correspond to the reel 102*b*.

While the embodiment according to the present invention has been described, the description presents only some of the specific examples and is not intended to limit the present invention in any way and specific constructions of each means and the like can be properly changed in terms of design. Moreover, the effects described in the embodiment of the present invention are only the most preferable effects generated from the present invention and the effects to be caused by the present invention is not limitative thereto.

What is claimed is:

1. A slot machine, comprising:

a first display device with a plurality of mechanical reels having plural types of symbols set in array, each of the symbols being associated with at least one outcome of a wagering game;

a second display device including both a symbol matrix display region configured to display therethrough, in column and row directions, the plurality of symbols set in array on the plurality of reels, and a symbol image display region configured to display a symbol image of a symbol not arranged in the symbol matrix display region;

a memory storing symbol image data relating to symbols identical or similar to the plural types of symbols set in array on the plurality of reels, and reel image data relating to a reel having a reel shape; and a controller operatively connected to the first display device, the second display device, and the memory, the controller being programmed to:

execute a basic game;

rearrange, by displaying in a scrolling manner, the plural types of symbols through the symbol matrix display region by controlling the plurality of reels during the basic game;

award a payout where the symbols displayed through the symbol matrix display region are arranged in a predetermined combination on a winning line;

read out of the memory the reel image data and the symbol image data corresponding to the symbol not arranged in the symbol matrix display region from among the symbols set in array on the plurality of reels;

generate, based on the reel image data and the symbol image data read out of the memory, image display data in which the symbol image of the symbol not arranged in the symbol matrix display region is filled in a reel image having the reel shape from among the symbols set in array on the plurality of reels; and display, in the symbol image display region, the reel image in which the symbol image is filled in the reel image having the reel shape in a manner to correspond to display on the symbol matrix display region based on the image display data.

2. The slot machine according to claim 1, wherein:

the reading out of memory step includes executing a first process and a second process;

the first process includes generating the image display data as if the reel is visually confirmed from a side of the symbol matrix display region; and the second process includes generating the image display data as if the reel is visually confirmed from an opposite side of the symbol matrix display region.

3. The slot machine according to claim 1, wherein the controller executes the reading out and the displaying steps responsive to arrangement of one of the symbols from among the symbols displayed in the symbol matrix display region not forming the predetermined combination on the winning line.

4. The slot machine according to claim 1, wherein the second display device includes a transparent liquid crystal panel located in front of the first display device, the transparent liquid crystal panel being controllable to switch the symbol image display region between transparent and opaque states.

5. The slot machine according to claim 1, wherein:

the memory stores frontside and backside symbol textures identical or similar to the plural types of symbols set in array on the plurality of reels, object data of a reel defined in a virtual three-dimensional space, and symbol array coordinate data for mapping the frontside and backside symbol textures on the object of the reel defined in the virtual three-dimensional space in a manner similar to array on the reel; and the reading out of memory step includes referring to the symbol array coordinate data on the object of the reel defined in the virtual three-dimensional space in the symbol image display region in a manner to correspond to display on the symbol matrix display region, based on the data read out of the memory, and then renders the object of the reel in real time by mapping the symbol textures of the symbol not arranged in the symbol matrix display region from among the symbols set in array on the plurality of reels.

6. A slot machine for playing a wagering game, the slot machine comprising:

a first display device with a plurality of mechanical reels having plural types of symbols set in array, each of the symbols being associated with at least one outcome of the wagering game;

a second display device including both a symbol matrix display region configured to display therethrough, column and row directions, the plurality of symbols set in array on the plurality of reels, and a symbol image display region configured to display a symbol image of a symbol not arranged in the symbol matrix display image;

a memory storing symbol image data relating to symbols identical or similar to the plural types of symbols set in array on the plurality of reels, and reel image data relating to a reel having a reel shape; and a controller operatively connected to the first display device, the second display device, and the memory, the controller being programmed to:

execute a basic game;

rearrange, by displaying in a scrolling manner, the plural types of symbols through the symbol matrix display region by controlling the plurality of reels during the basic game;

award a payout where the symbols displayed through the symbol matrix display region are arranged in a predetermined combination on a winning line;

read out of the memory the reel image data and symbol image data corresponding to the symbol not arranged in the symbol matrix display region from among the symbols set in array on the plurality of reels;

execute a first process and a second process, the first process generating, based on the reel image data and the symbol image data read out of the memory, image display data in which the symbol image of the symbol not arranged in the symbol matrix display region is filled in a reel image having the reel shape from among the symbols set in array on the plurality of reels, as if the reel is visually confirmed from a side of the symbol matrix display region, the second process generating the image display data as if the reel is visually confirmed from an opposite side of the symbol matrix display region; and display, in the symbol image display region, the symbol image filled in the reel image having the reel shape in a manner to correspond to display on the symbol matrix display region based on the image display data generated in the first process and the second process.

7. The slot machine according to claim 6, wherein the controller executes the reading out and the displaying steps responsive to arrangement of one of the symbols from among the symbols displayed in the symbol matrix display region not forming the predetermined combination on the winning line.

8. The slot machine according to claim 6, further comprising an input device for accepting operation input, wherein the second display device includes a transparent liquid crystal panel located in front of the first display device, the transparent liquid crystal panel being controllable to switch the symbol image display region between transparent and opaque states.

9. The slot machine according to claim 6, wherein:

the memory stores frontside and backside symbol textures identical or similar to the plural types of symbols set in array on the plurality of reels, object data of a reel defined in a virtual three-dimensional space, and symbol array coordinate data for mapping the frontside and backside symbol textures on the object of the reel defined in the virtual three-dimensional space in a manner similar to array on the reel; and the reading out of memory step includes referring to the symbol array coordinate data on the object of the reel defined in the virtual three-dimensional space in the symbol image display region in a manner to correspond to display on the symbol matrix display region, based on the data read out of the memory, and then renders the object of the reel in real time by mapping the symbol textures of the symbol not arranged in the symbol matrix display region from among the symbols set in array on the plurality of reels.

10. A slot machine, comprising:

a plurality of mechanical reels each having thereon plural types of symbols set in array, wherein the symbols are associated with outcomes of a wagering game;

a display device including a transparent liquid crystal panel with a symbol matrix display region configured to display therethrough, in column and row directions, the plurality of symbols on the reels, and a symbol image display region configured to display a symbol image of a symbol not arranged in the symbol matrix display region;

a memory storing frontside and backside symbol textures identical or similar to the plural types of symbols set in array on the mechanical reels, object data of a reel defined in a virtual three-dimensional space, and symbol array coordinate data for mapping the frontside and backside symbol textures to an object of the reel defined in the virtual three-dimensional space in a manner similar to array on the reel; and a controller operatively connected to the mechanical reels, the display device, and the memory, the controller being programmed to:

execute a basic game;

rearrange, by displaying in a scrolling manner, the plural types of symbols through the symbol matrix display region by controlling the plurality of reels during the basic game;

award a payout if the symbols displayed through the symbol matrix display region are arranged in a predetermined combination on a winning line;

read out of the memory frontside and backside symbol textures identical or similar to the symbol not arranged in the symbol matrix display region from among the symbols set in array on the reels, the object data of the reel defined in the virtual three-dimensional space, and the symbol array coordinate data;

refer to the symbol array coordinate data on the object of the reel defined in the virtual three-dimensional space in the symbol image display region in a manner to correspond to display on the symbol matrix display region, based on the data read out of the memory; and render the object of the reel in real time by mapping the symbol texture of the symbol not arranged in the symbol matrix display region from among the symbols set in array on the reel.

11. The slot machine according to claim 10, wherein:

the controller executes a first process and a second process;

the first process includes rendering the object of the reel in real time by mapping, with referring to the symbol array coordinate data, the symbol textures on the object of the reel defined in the virtual three-dimensional space as if the reel is visually confirmed from a side of the symbol matrix display region; and the second process includes rendering the object of the reel in real time by mapping, with referring to the symbol array coordinate data, the symbol textures on the object of the reel defined in the virtual three-dimensional space as if the reel is visually confirmed from an opposite side of the symbol matrix display region.

12. The slot machine according to claim 10, wherein the controller executes the reading out and the referring steps responsive to arrangement of one of the symbols from among the symbols displayed in the symbol matrix display region does not form the predetermined combination on the winning line.

13. The slot machine according to claim 10, wherein the transparent liquid crystal panel is located in front of the reels, the transparent liquid crystal panel being controllable to switch the symbol image display region between transparent and opaque states.

14. A gaming system for playing a wagering game, the gaming system comprising:

a first display device configured to display a plurality of reels, each of the reels bearing a plurality of symbols, each of the symbols being associated with at least one outcome of the wagering game;

a second display device adjacent the first display device, the second display device including a transparent liquid crystal panel with a symbol matrix display region and a symbol image display region, both the symbol matrix and the symbol image display regions being operable to transition between a transmissive state and an opaque state, at least a portion of the reels of the first display device being visible through the second display device when the symbol matrix display region is in the transmissive state, the symbol image display region being operable to display a symbol image of a symbol when in the opaque state;

a memory device configured to store symbol image data relating to the symbols of the plurality of reels, and reel image data relating to a reel having a reel shape; and one or more controllers operatively connected to the first display device, the second display device, and the memory device, the one or more controllers being configured to:

instruct the first display device to display an outcome of the wagering game;

determine whether the wagering-game outcome includes symbols on the plurality of reels being arranged in a predetermined winning symbol-combination;

generate, responsive to the wagering-game outcome not including symbols arranged in a predetermined winning symbol-combination, a reel image from reel image data and symbol image data read out of the memory device, the reel image and symbol image data corresponding to one or more symbols of the reels not included in the wagering-game outcome; and instruct the second display device to transition the symbol image display region into the opaque state and display thereon the reel image, the reel image including the one or more symbols of the reels not included in the wagering-game outcome.

15. A gaming system for playing a wagering game, the gaming system comprising:

a variable display device with a plurality of mechanical reels each having a plurality of symbols associated with an outcome of the wagering game, the outcome being randomly determined from a plurality of wagering-game outcomes;

a transmissive display device adjacent the variable display device, the transmissive display device including a transparent liquid crystal panel selectively operable to transition between a transmissive state, whereat symbols on the symbol-bearing reels are visible through the transmissive display device, and an opaque state, whereat selected ones of the symbols on the symbol-bearing reels are visibly obstructed by the transmissive display device; and one or more controllers operatively connected to the variable display device and the transmissive display device, the one or more controllers being configured to:

instruct the variable display device to display the symbols of the reels arranged in an array, the arranged symbols being indicative of an outcome of the wagering game;

determine weather the arranged symbols indicative of the wagering-game outcome includes symbols arranged in a predetermined winning symbol-combination;

generate, responsive to the wagering-game outcome not including symbols arranged in a predetermined winning symbol-combination, an image of a reel with a plurality of the symbols of the reels not included in the wagering-game outcome;

instruct the transmissive display device to transition a portion of the transparent liquid crystal panel into the opaque state and thereby visibly obstruct at least one of the reels displayed by the variable display device; and instruct the transmissive display device to display the image of the reel on the portion transitioned into the opaque state and visibly obstructing the at least one reel.

16. The gaming system of claim 15, further comprising a memory device configured to store symbol image data relating to the symbols of the plurality of reels, and reel image data relating to the image of the reel.

17. The gaming system of claim 15, wherein the generating step includes generating image display data representative of the at least one obstructed reel being viewed from a side of the symbol matrix display region, and generating additional image display data representative of the at least one obstructed reel being viewed from an opposite side of the symbol matrix display region.

18. The gaming system of claim 15, wherein the one or more controllers are further configured to:

generate, responsive to the wagering-game outcome not including symbols arranged in a predetermined winning symbol-combination, a second image of a reel with a plurality of the symbols of the reels not included in the wagering-game outcome;

instruct the variable display device to transition a second portion of the transparent liquid crystal panel into the opaque state and thereby visibly obstruct at least a second one of the reels displayed by the variable display device; and instruct the variable display device to display the second image of the reel on the second portion transitioned into the opaque state.

19. The gaming system of claim 15, wherein the one or more controllers are further configured to:

read from a memory device symbol texture data relating to the symbols of the plurality of reels, object data of a reel defined in a virtual three-dimensional space, and symbol array coordinate data for mapping the symbol textures on the object of the reel defined in the virtual three-dimensional space; and instruct the variable display device to display, based on the data read out of the memory device, the object of the reel in real-time by mapping the symbol textures of the symbol on the object of the reel defined in the virtual three-dimensional space.

20. The gaming system of claim 15, wherein the at least one visibly obstructed reel includes the plurality of symbols arranged in a respective order, and wherein the image of the reel displayed by the variable display device shows the same plurality of symbols arranged in the order.

* * * * *